US011588232B2

(12) United States Patent
Tulloch et al.

(10) Patent No.: US 11,588,232 B2
(45) Date of Patent: Feb. 21, 2023

(54) FLEXIBLE RADOME STRUCTURES

(71) Applicant: CommScope Technologies LLC, Hickory, NC (US)

(72) Inventors: Thomas C. Tulloch, Aberdour (GB); Griogair Whyte, Larbert (GB); Donald B. Gardner, Livingston (GB); Matthew Lewry, Limekilns (GB); Craig Mitchelson, Cumbernauld (GB); Steven William Bell, Glenrothes (GB)

(73) Assignee: CommScope Technologies LLC, Hickory, NC (US)

( * ) Notice: Subject to any disclaimer, the term of this patent is extended or adjusted under 35 U.S.C. 154(b) by 1 day.

(21) Appl. No.: 17/284,257

(22) PCT Filed: Oct. 9, 2019

(86) PCT No.: PCT/US2019/055349
§ 371 (c)(1),
(2) Date: Apr. 9, 2021

(87) PCT Pub. No.: WO2020/076918
PCT Pub. Date: Apr. 16, 2020

(65) Prior Publication Data

US 2021/0384623 A1 Dec. 9, 2021

Related U.S. Application Data

(60) Provisional application No. 62/744,880, filed on Oct. 12, 2018.

(51) Int. Cl.

| | |
|---|---|
| ***H01Q 1/42*** | (2006.01) |
| ***H01Q 15/16*** | (2006.01) |
| ***H01Q 19/13*** | (2006.01) |

(52) U.S. Cl.
CPC ..... *H01Q 1/427* (2013.01); *H01Q 15/161* (2013.01); *H01Q 19/134* (2013.01)

(58) Field of Classification Search
CPC .... H01Q 1/427; H01Q 15/161; H01Q 19/134; H01Q 15/16; H01Q 1/1207
See application file for complete search history.

(56) References Cited

U.S. PATENT DOCUMENTS

| | | | |
|---|---|---|---|
| 3,388,401 | A | 6/1968 | Weir |
| 6,137,449 | A | 10/2000 | Kildal |

(Continued)

FOREIGN PATENT DOCUMENTS

| | | | |
|---|---|---|---|
| CN | 108461916 | A | 8/2018 |
| EP | 3220548 | A1 | 9/2017 |

(Continued)

OTHER PUBLICATIONS

Extended European Search Report for corresponding European Application No. 19870452.0 (16 pages) (dated Apr. 28, 2022).

(Continued)

*Primary Examiner* — Hoang V Nguyen
(74) *Attorney, Agent, or Firm* — Myers Bigel, P.A.

(57) ABSTRACT

An antenna structure includes a radiator element configured for operation at a first microwave frequency range and at a second microwave frequency range that is higher than the first microwave frequency range, and a reflector including the radiator element attached thereto. The reflector includes an enclosure that houses the radiator element and a radiating aperture. The antenna structure further includes a radome assembly adjacent the radiating aperture. The radome assembly includes a flexible radome having a thickness that is less than a wavelength corresponding to the first or second microwave frequency ranges, and a tensioning member that (Continued)

extends along a perimeter of the flexible radome and maintains tension in a surface of the flexible radome.

21 Claims, 13 Drawing Sheets

(56) References Cited

U.S. PATENT DOCUMENTS

| | | | |
|---|---|---|---|
| 2011/0285604 | A1 | 11/2011 | Le et al. |
| 2016/0149297 | A1 | 5/2016 | Tasker et al. |
| 2017/0301983 | A1 | 10/2017 | Renilson et al. |

FOREIGN PATENT DOCUMENTS

| | | | | | |
|---|---|---|---|---|---|
| FR | 2544553 | A1 | | 10/1984 | |
| KR | 1020170010373 | A | * | 1/2017 | ..... H01Q 15/16 |

OTHER PUBLICATIONS

Notification of Transmittal of the International Search Report and the Written Opinion of the International Searching Authority, or the Declaration, in corresponding PCT Application No. PCT/US2019/055349 (dated Jan. 2, 2020).

* cited by examiner

FLEXIBLE RADOME STRUCTURES

CLAIM OF PRIORITY

The present application is a 35 U.S.C. § 371 national stage application of PCT Application No. PCT/US2019/055349, filed on Oct. 9, 2019, which itself claims the benefit of priority under 35 U.S.C. 119 from U.S. Provisional Patent Application No. 62/744,880, filed Oct. 12, 2018, the entire contents of both of which are incorporated by reference herein. The above-referenced PCT Application was published in the English language as International Publication No. WO 2020/076918 A1 on Apr. 16, 2020.

FIELD

The present invention relates generally to antennas and, more particularly, to radome structures for antennas and related mounting structures.

BACKGROUND

Microwave transmission refers to the transmission of information or energy by electromagnetic waves whose wavelengths are measured in units of centimeters or millimeters. These electromagnetic waves are called microwaves. The "microwave" portion of the radio spectrum ranges across a frequency band of approximately 1.0 GHz to approximately 300 GHz. These frequencies correspond to wavelengths in a range of approximately 30 centimeters to 0.1 centimeters.

Microwave communication systems may be used for point-to-point communications because the small wavelength of the electromagnetic waves may allow relatively small sized antennas to direct the electromagnetic waves into narrow beams, which may be pointed directly at a receiving antenna. This ability to form narrow antenna beams may allow nearby microwave communications equipment to use the same frequencies without interfering with each other as lower frequency electromagnetic wave systems may do. In addition, the high frequency of microwaves may give the microwave band a relatively large capacity for carrying information, as the microwave band has a bandwidth approximately thirty times the bandwidth of the entirety of the radio spectrum that is at frequencies below the microwave band. Microwave communications systems, however, are limited to line of sight propagation as the electromagnetic waves cannot pass around hills, mountains, structures, or other obstacles in the way that lower frequency radio waves can.

Parabolic reflector antennas are often used to transmit and receive microwave signals. FIG. 13 is a partially-exploded, rear perspective view of a conventional microwave antenna system 10 that uses a parabolic reflector antenna. As shown in FIG. 13, the antenna system 10 includes a parabolic reflector antenna 20, a feed assembly 30 and a hub 50. The parabolic reflector antenna 20 may include, for example, a dish-shaped structure that is formed of metal or that has a metal inner surface (the inner metal surface of antenna 20 is not visible in FIG. 10). The hub 50 may be used to mount the parabolic reflector antenna 20 on a mounting structure (not shown) such as a pole, antenna tower, building or the like. The hub 50 may be mounted on the rear surface of the parabolic reflector antenna 20 by, for example, mounting screws. The hub 50 may include a hub adapter 52. A transition element 54 may be received within the hub adapter 52. The transition element 54 may be designed to efficiently launch RF signals received from, for example, a radio (not shown) into the feed assembly 30. The transition element 54 may comprise, for example, a rectangular-to-circular waveguide transition that is impedance matched for a specific frequency band.

An opening or bore 22 is provided at the middle (bottom) of the dish-shaped antenna 20. The hub adapter 52 may be received within this bore 22. The transition element 54 includes a bore 56 that receives the feed assembly 30. The feed assembly 30 may include, for example, a circular waveguide 32 and a sub-reflector 40. The circular waveguide 32 may have a tubular shape and may be formed of a metal such as, for example, aluminum. When the feed assembly 30 is mounted in the hub adapter 52 and the hub adapter 52 is received within the bore 22, a base of the circular waveguide 32 may be proximate the bore 22, and a distal end of the circular waveguide 32 and the sub-reflector 40 may be in the interior of the parabolic reflector antenna 20. A low-loss dielectric block 34 may be inserted into the distal end of the circular waveguide 32. A distal end of the low-loss dielectric block 34 may have, for example, a stepped generally cone-like shape. The sub-reflector 40 may be mounted on the distal end of the dielectric block 34. In some cases, the sub-reflector 40 may be a metal layer that is sprayed, brushed, plated or otherwise formed on a surface of the dielectric block 34. In other cases, the sub-reflector 40 may comprise a separate element that is attached to the dielectric block 34. The sub-reflector 40 is typically made of metal and is positioned at a focal point of the parabolic reflector antenna 20. The sub-reflector 40 is designed to reflect microwave energy emitted from the circular waveguide 32 onto the interior of the parabolic reflector antenna 20, and to reflect and focus microwave energy that is incident on the parabolic reflector antenna 20 into the distal end of the circular waveguide 32.

Microwave antenna systems have been provided that operate in multiple frequency bands. For example, the UMX® microwave antenna systems sold by CommScope, Inc. of Hickory, N.C. operate in two separate microwave frequency bands. These antennas include multiple waveguide feeds, each of which directly illuminates a parabolic reflector antenna. Other dual-band designs have been proposed where a first feed directly illuminates a parabolic reflector antenna and a second feed illuminates the parabolic reflector antenna via a sub-reflector. U.S. Pat. No. 6,137,449 also discloses a dual-band reflector antenna design that includes a coaxial waveguide structure. Radomes are typically applied to the open end of reflector antennas to reduce wind load, improve antenna aesthetics, and/or seal/protect the feed assembly and/or reflector dish surfaces.

SUMMARY

According to some embodiments of the present invention, an antenna structure includes a radiator element configured for operation at a first microwave frequency range and at a second microwave frequency range that is higher than the first microwave frequency range; a reflector including the radiator element attached thereto, the reflector including an enclosure that houses the radiator element and a radiating aperture; and a radome assembly adjacent the radiating aperture. The radome assembly includes a flexible radome having a thickness that is less than a wavelength corresponding to the first or second microwave frequency ranges, and a tensioning member that extends along a perimeter of the flexible radome and maintains tension in a surface of the flexible radome.

In some embodiments, the flexible radome may include a sleeve extending along the perimeter thereof. The tensioning member may include a flexible rod extending through the sleeve and a connection member connecting ends of the flexible rod.

In some embodiments, the connection member may include male and female members at the ends of the flexible rod, respectively. An amount of insertion of the male member into the female member may be adjustable to alter the perimeter of the flexible radome and the tension in the surface thereof independent of attachment of the radome assembly to the antenna structure.

In some embodiments, the antenna structure may further include a single- or multi-segment shield rim that extends around the perimeter of the flexible radome and attaches the radome assembly to a rim of the reflector adjacent the radiating aperture.

In some embodiments, the shield rim may include a plurality of holes in an inner edge thereof, and the flexible radome may be attached to the holes in the shield rim by respective plugs along the perimeter thereof to maintain the tension in the surface of the flexible radome independent of attachment of the radome assembly to the antenna structure.

In some embodiments, the shield rim may include a retaining channel therein that is sized to accept the tensioning member of the radome assembly along an inner edge thereof, and an attachment structure that attaches to the rim of the reflector.

In some embodiments, the attachment structure of the shield rim may include a lip portion including a plurality of holes therein that are sized to accept respective plugs to attach to the rim of the reflector.

In some embodiments, the rim of the reflector may include a shield member extending along a perimeter thereof. The shield member may include an edge protruding away from the reflector beyond the rim, and the attachment structure of the shield rim may include an attachment channel portion extending along the outer edge thereof and sized to accept the edge of the shield member.

In some embodiments, the rim of the reflector may include a rolled edge, and the attachment structure of the shield rim may include a clip portion that is sized to accept the rolled edge of the rim of the reflector.

In some embodiments, the rim of the reflector may include a compressible absorber member extending along and within a boundary defined by the rim.

In some embodiments, the tensioning member may further include an expandable disc having a first surface that abuts the surface of the flexible radome.

In some embodiments, the expandable disc may include an outer lip that is thinner than an inner portion thereof and is sized to fit between the compressible absorber member and the retaining channel of the shield rim.

In some embodiments, the reflector may include a rim having a rolled edge defining a retaining channel that is sized to accept the tensioning member of the radome assembly. The tensioning member may be configured to expand in the retaining channel responsive to deformation thereof to secure the radome assembly to the rim of the reflector.

In some embodiments, the thickness of the flexible radome may be at least ten times less than the wavelength corresponding to the first or second microwave frequency ranges.

In some embodiments, the first and second frequency ranges may be multiple octaves apart.

In some embodiments, the flexible radome may have a thickness of about 3 centimeters (cm) to about 0.01 cm.

According to some embodiments of the present invention, a radome assembly for an antenna structure includes a flexible radome having a thickness that is less than a wavelength corresponding to first or second microwave frequency operating ranges of the antenna structure; and a tensioning member that extends along a perimeter of the flexible radome and maintains tension in a surface of the flexible radome independent of attachment of the radome assembly to the antenna structure.

In some embodiments, the flexible radome may include a sleeve extending along the perimeter thereof. The tensioning member may include a flexible rod extending through the sleeve and a connection member connecting ends of the flexible rod.

In some embodiments, the connection member may include male and female members at the ends of the flexible rod, respectively. An amount of insertion of the male member into the female member may be adjustable to alter the perimeter of the flexible radome and the tension in the surface thereof.

In some embodiments, the tensioning member may include a single- or multi-segment shield rim that extends around the perimeter of the flexible radome. The shield rim may include a plurality of holes in an inner edge thereof, and the flexible radome may be attached to the holes in the shield rim by respective plugs along the perimeter thereof to maintain the tension in the surface of the flexible radome.

In some embodiments, the thickness of the flexible radome may be at least ten times less than the wavelength corresponding to the first or second microwave frequency ranges.

In some embodiments, the first and second frequency ranges may be multiple octaves apart, and/or the flexible radome may have a thickness of about 3 centimeters (cm) to about 0.01 cm.

Other antenna structures, apparatus, and/or methods according to some embodiments will become apparent to one with skill in the art upon review of the following drawings and detailed description. It is intended that all such additional embodiments, in addition to any and all combinations of the above embodiments, be included within this description, be within the scope of the invention, and be protected by the accompanying claims.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain principles of the invention.

DETAILED DESCRIPTION OF EMBODIMENTS

Figure 1A:
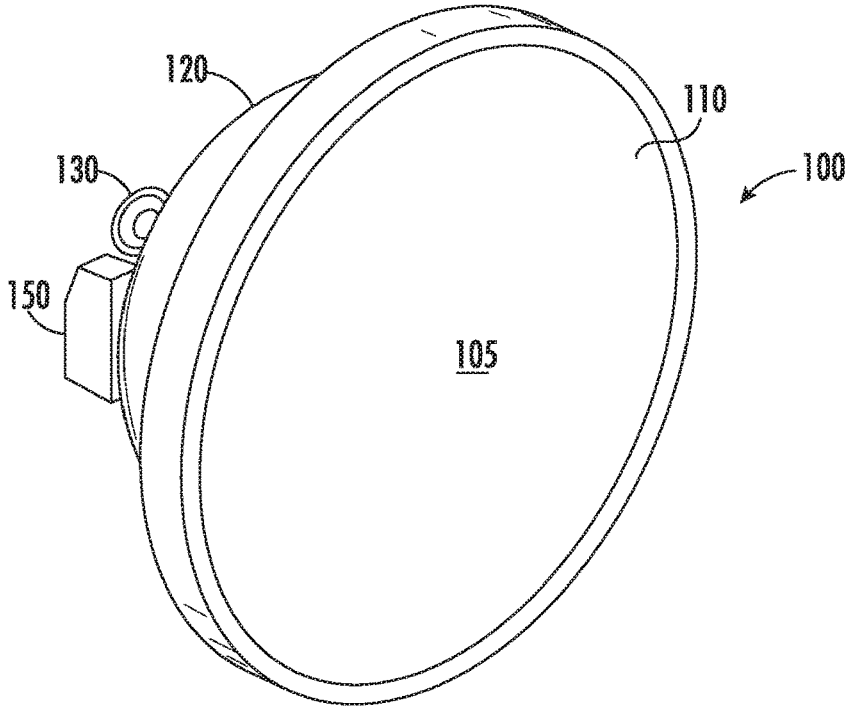
FIGS. 1A and 1B are perspective and exploded views, respectively, illustrating flexible radome structures for multi-band operation in accordance with some embodiments described herein.

As described herein, an antenna structure may generally refer to an entire structure that may be mounted to a customer's equipment, including the antenna or radiator element (which transmits/receives electromagnetic radiation) and the enclosure (which protects the radiator element from the operating environment). The enclosure may thus refer to the structure or component that houses or encloses the radiator element to provide environmental protection, such as a reflector dish (e.g., of a parabolic reflector antenna), generally referred to herein as a "reflector." A radome may surround and protect the radiator element and/or other components in the enclosure. A radome may refer to a component that is arranged in front of or on the radiating aperture or surface of the radiator element. The radome may be stand-alone component of a different material and/or thickness than the enclosure. For example, radome designs may include rigid or semi-rigid dielectric polymer covers, or flexible fabric covers that may be held in tension across the open end of the reflector.

Embodiments described herein may arise from realization that some existing radome designs may be optimized for one desired operating frequency or frequency range, but may not be suitable for multi-band antennas that are configured for operation at multiple frequencies/ranges. For example, injection-molded polymer radomes may be designed to provide desired performance in higher-frequency (e.g., 80 GHz) microwave antenna applications, and fabric radomes may be designed to provide desired performance in lower-frequency (e.g., 26 GHz) microwave antenna applications, but neither may provide suitable electrical characteristics for use at multiple microwave frequencies.

Accordingly, some embodiments described herein provide flexible radome structures that are configured to provide desired electrical characteristics (e.g., gain, directivity) for operation at multiple frequency bands, including frequency bands that are several octaves apart. In particular, flexible radome assemblies described herein may utilize fabrics, membranes, and/or other flexible materials that are electrically thin (e.g., having radome thicknesses that are much less than the corresponding wavelengths of operation) at multiple desired operating frequency bands, while maintaining desired mechanical properties (e.g., water-resistance or hydrophobicity, tear resistance, resistance to stretching or relaxation under tension, etc.) for protection of the components internal to the enclosure. For example, some embodiments described herein provide flexible radome structures configured for dual- or multi-frequency band operation, with a radome thickness t that is about one-tenth or less than the corresponding wavelength $\lambda$ (i.e., $t=0.1\lambda$) for the operating frequency. In multi-band microwave applications (for multiple operating frequencies or frequency ranges that fall within approximately 1.0 GHz to approximately 300 GHz), the radomes described herein may have a thickness of about 3 centimeters (cm) to about 0.01 cm. In one non-limiting example, a radome in accordance with embodiments described herein may be configured for dual-band operation at 23 GHz and 80 GHz, and may have a thickness of about 0.15 millimeters (mm) to about 0.05 mm. In another non-limiting example, a radome in accordance with embodiments described herein may be configured for dual-band operation at 10 GHz and 38 GHz, and may have a thickness of about 0.3 mm to about 0.05 mm.

Further embodiments described herein provide radome assemblies with integrated tensioning structures that are configured to mechanically tension the radomes, and attachment structures for mounting the tensioned radome assemblies to the reflector housing or other antenna enclosure. The integrated tensioning structure may apply tension to the surface of the flexible radome independent of the attachment to the reflector or other enclosure. The integrated tensioning structure may also include an integrated attachment structure in some embodiments. The tensioning and/or attachment mechanisms described herein may further contribute to consistency of the radiation patterns at the multiple frequency bands of operation. As such, flexible radome structures as described herein may provide not only environmental protection, but may also be configured (e.g., with respect to shapes, radome thicknesses, tensioning mechanisms, and/or attachment mechanisms) to have no substantial impact on radiation patterns, that is, so as to be "electrically invisible" at multiple frequency bands of operation. Although described herein primarily with reference to parabolic reflector-based antenna structures, it will be understood that flexible radome structures as described herein may be applied to other antenna enclosure shapes. Also, particular operating frequencies are described herein by way of example rather than limitation, and embodiments as described herein may provide desired electrical characteristics for multiple microwave operating frequencies/ranges that are higher or lower than those specifically mentioned.

Figure 1B:
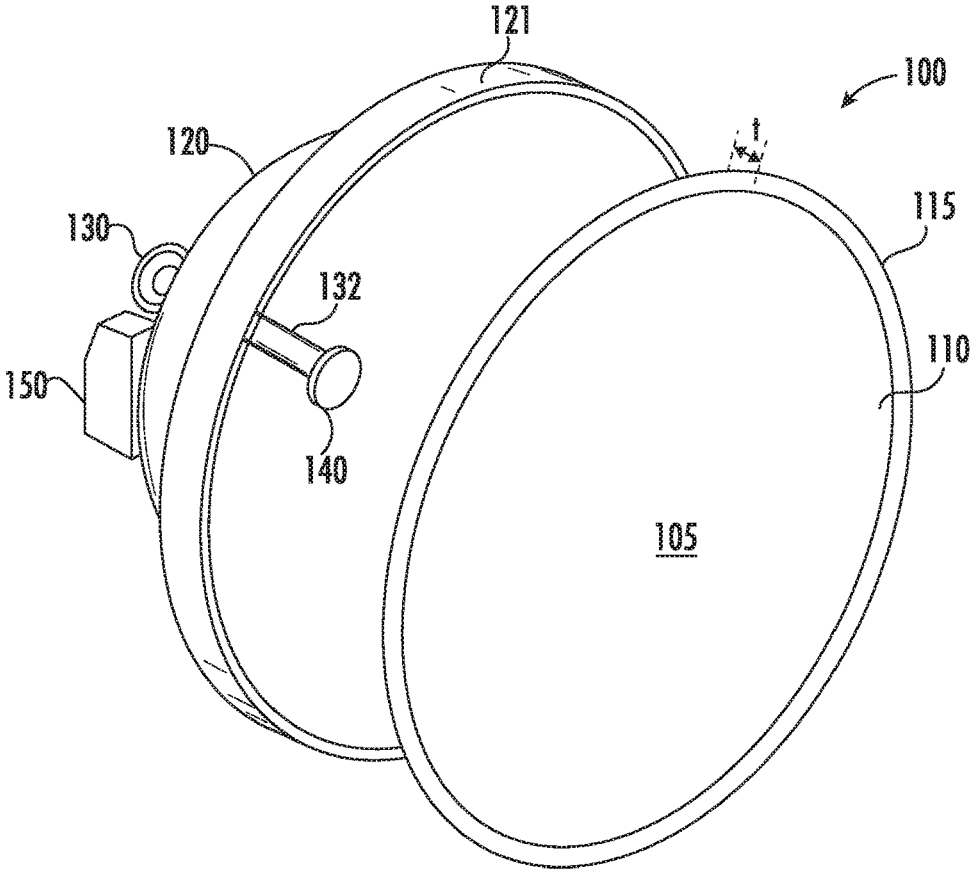

FIGS. 1A and 1B are perspective and exploded views, respectively, of a flexible radome structure 100 configured for multi-band operation in accordance with some embodiments described herein. As shown in FIGS. 1A and 1B, the flexible radome structure 100 includes an antenna enclosure (illustrated as a reflector 120) including a bore through which a feed antenna assembly (also referred to herein as a radiator element 130) extends, and a radome assembly 110 adjacent or covering the radiating aperture at the open end of the reflector 120 to provide environmental protection for the radiator element 130 therein. The radiator element 130 includes a waveguide 132 and a sub-reflector 140 at an end of the waveguide. The sub-reflector 140 may be made of metal and is positioned at a focal point of the reflector 120. The sub-reflector 140 is designed to reflect microwave energy emitted from the waveguide 132 onto the interior of the reflector 20, and to reflect and focus microwave energy that is incident on the reflector 20 into the end of the waveguide 132. The radiator element 130 is configured for operation at multiple frequencies or frequency ranges, including (but not limited to) multiple microwave operating frequencies/ranges of approximately 1.0 GHz to approximately 300 GHz, which can be multiple octaves apart. A hub 150 may be used to mount the reflector 120 on a mounting structure, such as a pole, antenna tower, building or the like. The hub 150 may be mounted on the outer surface of the reflector 120 by, for example, mounting screws. The hub 150 and radiator element/feed assembly 130 may be similarly included in multiple embodiments described herein, and further description is omitted.

The radome assembly 110 includes a flexible radome 105 that is mounted on a tensioning structure or member 115. The flexible radome 105 may be made of a fabric (e.g., a woven fabric), membrane, or other composition or material that provides water-resistance or hydrophobicity, tear resistance (even if punctured), and/or stretch resistance, while maintaining a desired shape when tensioned by the tensioning member 115. As noted above, the flexible radome 105 has a thickness t that is much less than the corresponding wavelengths at multiple desired operating frequencies or frequency ranges, so as to have no substantial impact on radiation patterns and allowing for multi-band operation.

The tensioning member 115 extends along a perimeter of the flexible radome and is configured to apply tension to a surface of the flexible radome 105 so as to maintain a taut surface adjacent the aperture in front of the radiator element 130, providing environmental protection as well as consistency of radiation patterns. The flexible radome 105 can be attached to the tensioning member 115 via stitching, glue/adhesive, plastic clamps, plastic studs, and/or other attachment elements (e.g., non-conductive elements) that do not substantially affect radiation patterns. The tensioning member 115 can be implemented using a screwable tensioning rod, a drawstring fixed by cleat or jammer, a spring loaded member, a lever system, etc. The tensioning member 115 is also configured to be attached to the reflector 120 to secure the flexible radome 105 thereon. That is, the tensioning member 115 can provide both a tensioning structure for maintaining tension in a surface of the flexible radome 105, and a mounting structure for attaching the flexible radome 105 to the reflector 120. Embodiments described in greater detail herein illustrate attachment of the tensioning member 115 to the rim 121 of the reflector 120 by way of example rather than limitation, and it will be understood that other attachment points may be used. In some embodiments, the tensioning member 115 can be attached to a surface using attachment elements including (but not limited to) screws, glue, pins, rings, etc.

Figure 2A:
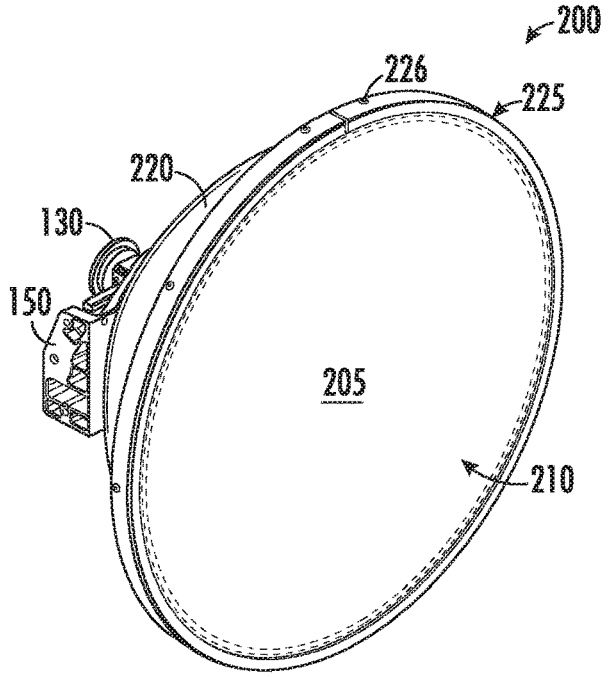
FIGS. 2A and 2B are perspective and exploded views, respectively, illustrating flexible radome structures for multi-band operation in accordance with further embodiments described herein.
Figure 2B:
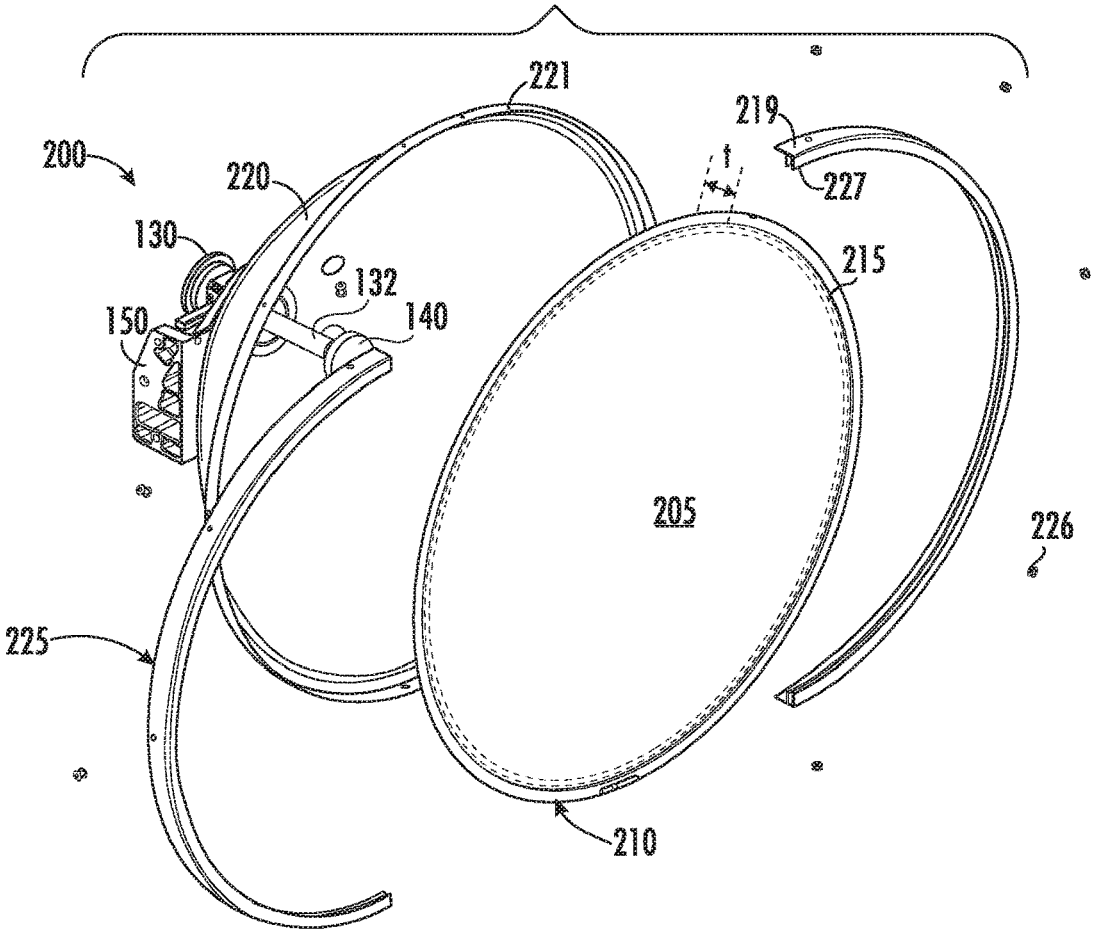

FIGS. 2A and 2B are perspective and exploded views, respectively, of a flexible radome structure 200 configured for multi-band operation in accordance with further embodiments described herein. As shown in FIGS. 2A and 2B, the flexible radome structure 200 includes a flexible radome assembly 210 that is attached to a rim 221 of a reflector 220 by a shield rim 225 and a plurality of rivets 226. More particularly, FIG. 2B illustrates the shield rim 225 as including segments 225*a*, 225*b*, which have respective slots 227 that are sized to accept the outer edge of the radome assembly 210, The slots 227 defined by the two segments 225*a*, 225*b* of the shield rim 225 define a circumferential retaining channel 227 that is sized to accept a tensioning member 215 extending along the periphery of the radome assembly 210, which maintains the tension in a surface of the flexible (e.g., fabric) radome 205. The shield rim 225 also includes a lip portion 219 that is sized to accept the rim 221 of the reflector 220. While illustrated in FIG. 2B as including two halves or segments 225*a*, 225*b* that collectively define a complete circumferential retaining channel 227 by way of example, it will be understood that the shield rim 225 may be include more segments, a single member, or may define a partial retaining channel that extends less than the complete circumference in some embodiments.

Still referring to FIGS. 2A and 2B, assembly of the flexible radome structure 200 may include assembling the segments 225*a*, 225*b* of the shield rim 225 on opposing sides of the radome assembly 210, by sliding the slots 227 in the segments 225*a*, 225*b* over the tensioning member 215. The lip 219 of the shield rim 225 and the rim 221 of the reflector 220 respectively include a plurality of holes therein that are sized to accept the rivets 226, and the shield rim 225 (including the radome assembly 210 between the slots 227 therein) may thus be attached to the rim 221 of the reflector 220 by inserting the rivets 226 into the holes in the lip 222. It will be understood that the use of rivets herein is described by way of example only, and thus, other attachment elements (e.g., studs, plugs, screws, twist-lock pins, levers, etc.) may be similarly used to secure the shield rim to the reflector rim.

Figure 3A:
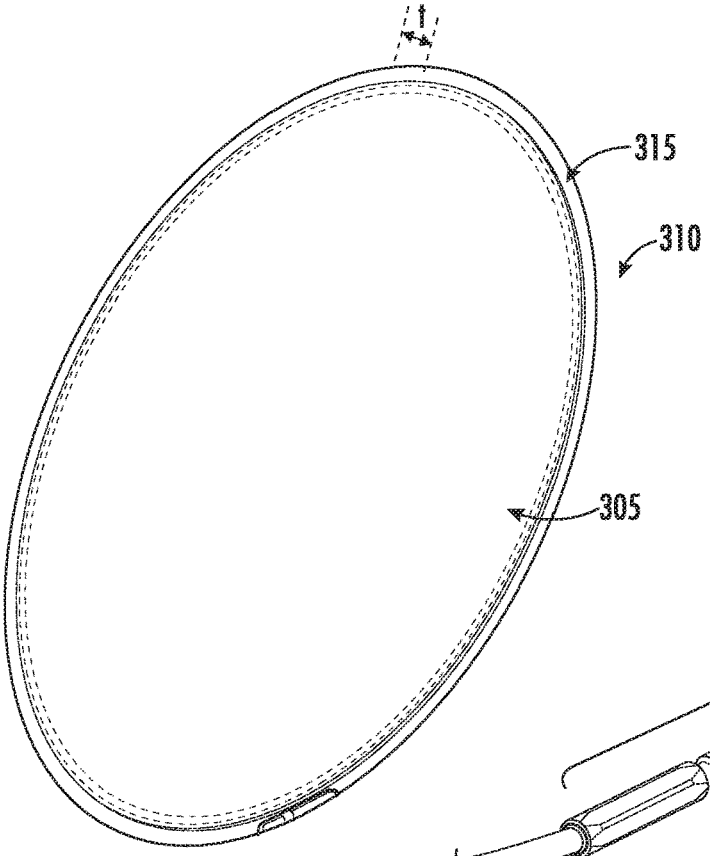
FIG. 3A is a perspective view illustrating flexible radome assemblies for multi-band operation in accordance with some embodiments described herein.
Figure 3B:
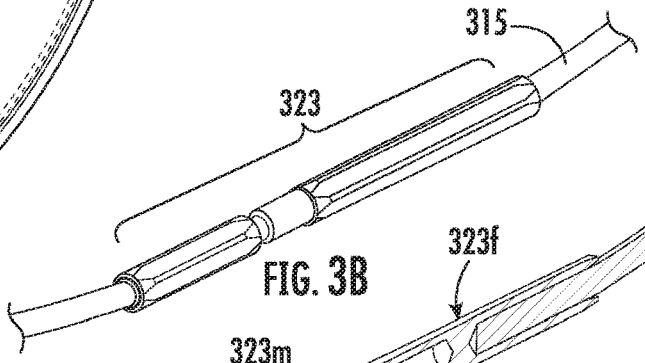
FIG. 3B is an enlarged view of the connection members of the radome assembly of FIG. 3A.
Figure 3C:
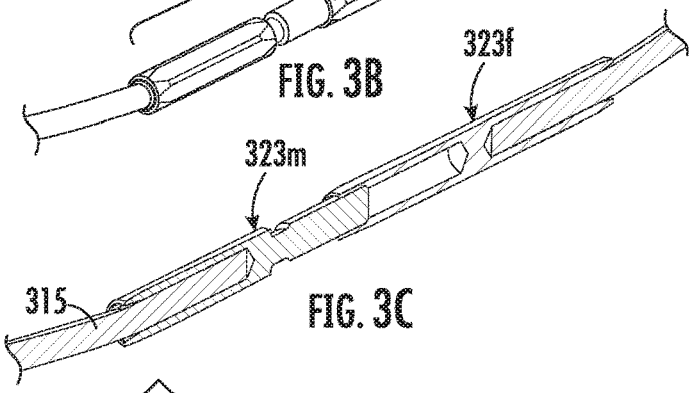
FIG. 3C is a cross-sectional view of the connection members of FIG. 3B.

FIGS. 3A, 3B, and 3C are perspective, enlarged, and cross-sectional views, respectively, illustrating a flexible radome assembly 310 and components thereof for multi-band operation in accordance with some embodiments described herein. The radome assembly 310 may be representative of embodiments of radome assemblies described herein, for example, the radome assemblies 110 or 210 described above, or 410 described below.

As shown in FIGS. 3A-3C, the radome assembly 310 includes a bendable rod 315 (for example, a fiberglass rod) including a male connection member 323*m* and a female connection member 323*f* (for example, a male thimble and a female thimble) attached at respective ends thereof to define connected ends 323, and a fabric (or other flexible material) radome 305. The female connection member 323*f* may include a threaded or other internal cavity that is configured to accept the male connection member 323*m*, such that the circumference of an ellipse (or perimeter of other shapes) defined by bending the rod 315 can be adjusted by adjusting the amount of insertion of the male connection member 323*m* into the female connection member 323*f* (e.g., by fully or partially screwing the male connection member 323*m* into the female connection member 323*f*).

Figure 3D:
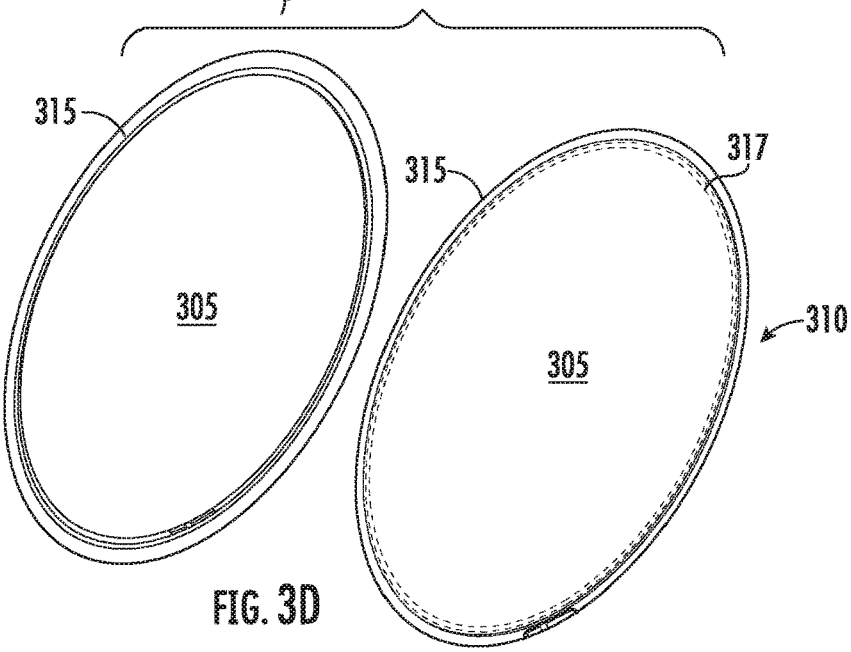
FIG. 3D illustrates operations for fabricating the radome assembly of FIG. 3A.

FIG. 3D illustrates operations for fabricating the radome assembly of FIG. 3A. As shown in FIG. 3D, after bending the rod 315 to define an elliptical shape, the male connection member 323*m* is screwed into the female connection member 323*f*. Outer edges of the flexible radome 305 are folded over the circumference of the elliptical shape defined by the bent rod 315 and secured to the rod 315 (for example by stitching, welding, or gluing, generally shown as 317), leaving a gap at least partially exposing the connected ends 323 defined by insertion of the male connection member 323*m* into the female connection member 323*f*. Edges of the flexible radome 305 folded and secured around the rod 315 may define a fabric tube or sleeve, which has an opening that is sized and configured to allow the rod 315 to slide therethrough. The amount of insertion of the male connection member 323*m* into the female connection member 323*f* is then reduced (e.g., by unscrewing the connection members 323*m*, 3230, sliding the rod 315 within the fabric sleeve to expand the circumference of the circle defined by the rod 315, thereby creating tension in the surface of the flexible radome 305. Once tensioned, the rod assembly 310 may be completed, for example, by stitching, welding, or gluing the remaining portion of the flexible radome 305 to close the gap around the connection member 323.

Figure 4A:
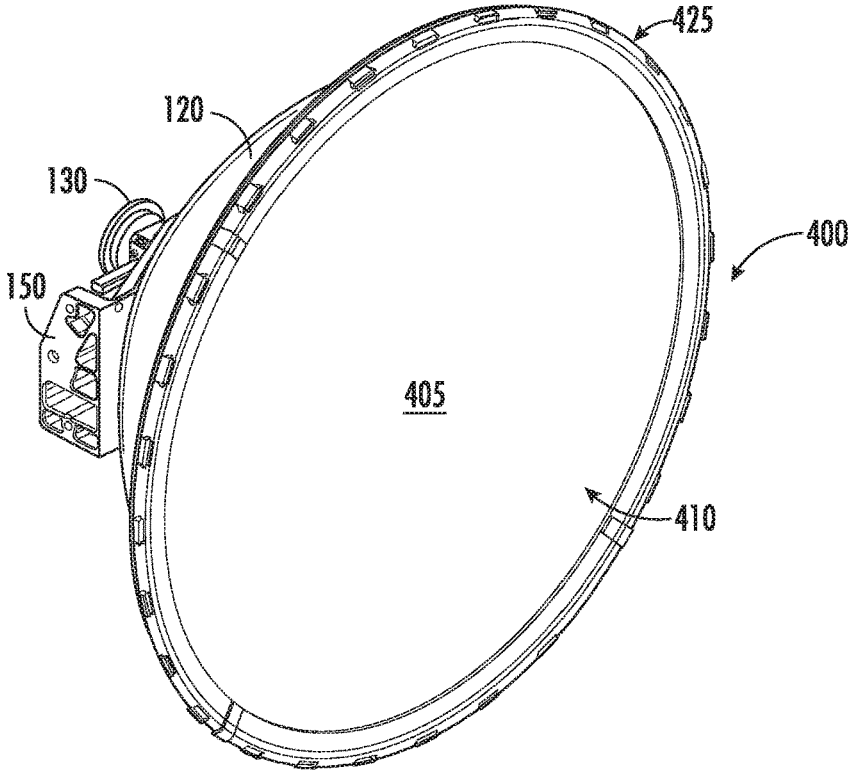
FIGS. 4A and 4B are perspective and exploded views, respectively, illustrating flexible radome structures for multi-band operation in accordance with still further embodiments described herein.
Figure 4C:
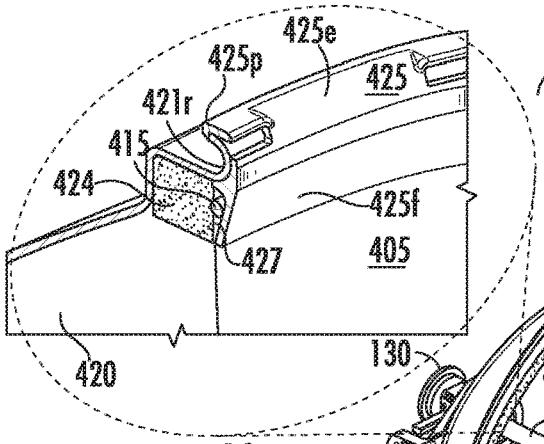
FIG. 4C is an enlarged view illustrating a cross-section of a portion of the reflector rim of the flexible radome structure of FIG. 4B.

FIGS. 4A and 48 are perspective and exploded views, respectively, of a flexible radome structure 400 configured for multi-band operation in accordance with still further embodiments described herein. FIG. 4C is an enlarged view illustrating a cross-section of a portion of the reflector rim of the flexible radome structure of FIG. 4B.

Figure 4B:
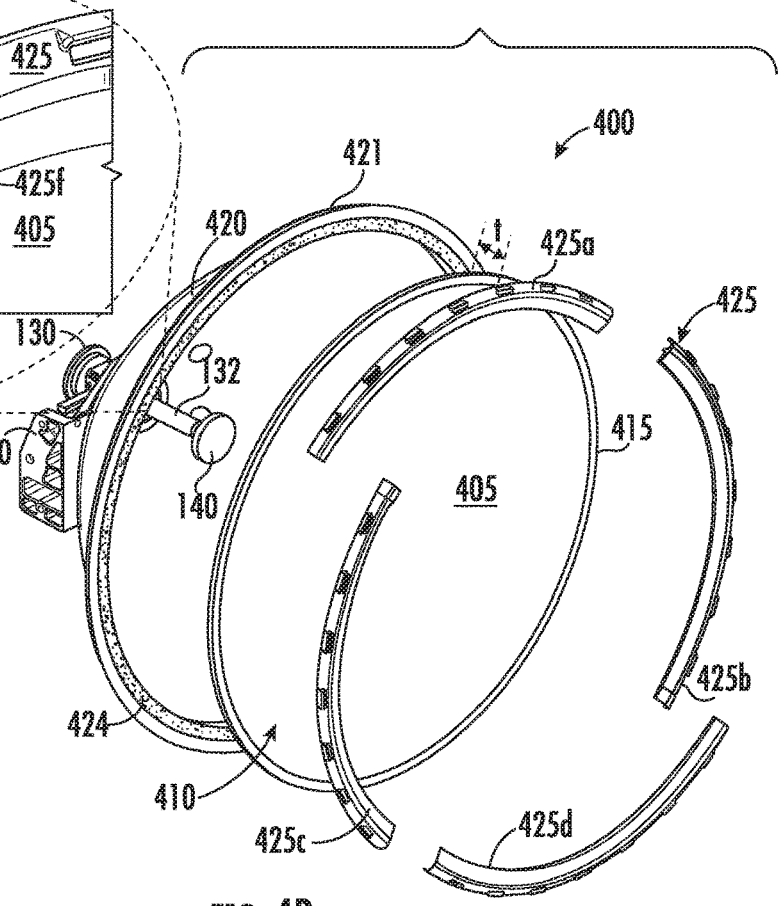

As shown in FIGS. 4A-4C, the flexible radome structure 400 includes a flexible radome assembly 410 that is attached to a rim 421 of a reflector 420 by a shield rim 425. More particularly, FIG. 4B illustrates the shield rim 425 as a molded plastic or other non-conductive member including segments 425*a*, 425*b*, 425*c*, 425*d* that collectively define an inner perimeter or circumference that is sized to be attached to an outer perimeter or circumference of the radome assembly 410. The reflector 420 also includes a compressible absorber member 424 extending along and within a boundary defined by the rim 421. The absorber member 424 may be a pliable material, which may expand responsive to compression to provide a secure fit or seal around the internal cavity of the reflector 420, and may have a circumference that is similar or identical to that of the elliptical shape defined by the tensioning member 415 of the radome assembly 410, which maintains tension in a surface in the flexible (e.g., fabric) radome 405 supported thereby.

The rim 421 of the reflector 420 also includes a rolled edge 421*r* that is sized to fit in a corresponding clip portion 425*p* at the outer edge 425*e* of each of the shield rim segments 425*a*, 425*b*, 425*c*, 425*d*. The inner edge 425*f* of each of the shield rim segments 425*a*, 425*b*, 425*c*, 425*d* is tapered such that, when the clip portion 425*p* at the outer edge 425*e* is attached to the rim 421, the inner edge 425*f* and the absorber member 424 collectively define a retaining channel 427 that is sized to hold the radome assembly 410. In particular, the tapering of the inner edge 425*f* continually decreases a size of the retaining channel 427 from a width that is sufficient to accept a diameter the tensioning member 415 of the radome assembly 410 at one depth, to a width that is similar to the thickness t of the flexible radome 405 at another (shallower) depth. The width of the retaining channel 427 may refer to a distance between the inner edge 425*f* of the shield rim 425 and the absorber member 424 at various depths of the retaining channel 427.

The radome assembly 410 may thus be placed onto the outwardly-facing surface of the absorber member 424, and the shield rim segments 425*a*, 425*b*, 425*c*, 425*d* may be assembled by attaching the respective clip portions 425*p* thereof to the rolled edges 421*r* of the rim 421 of the reflector 420, compressing the radome assembly against the surface of the absorber member 424. The absorber member 424 expands to securely hold the tensioning member 415 in the retaining channel 427 defined by the surface of the absorber member 424 and the inner edge 425*f* of the shield rim segments 425*a*, 425*b*, 425*c*, 425*d*. That is, the radome assembly 410 is held in place by a snap-fit between the segments 425*a*, 425*b*, 425*c*, 425*d* of the shield rim 425 and the rolled edge 421*r* of the rim/surface of the absorber member 424. While illustrated in FIG. 4B as including four segments 425*a*-425*d* that collectively define a complete circumference around the rim 421 by way of example, it will be understood that the shield rim 425 may include more segments, may be a single member, or may define only a partial circumference around the rim 421 in some embodiments.

Figures 5A, 5B:
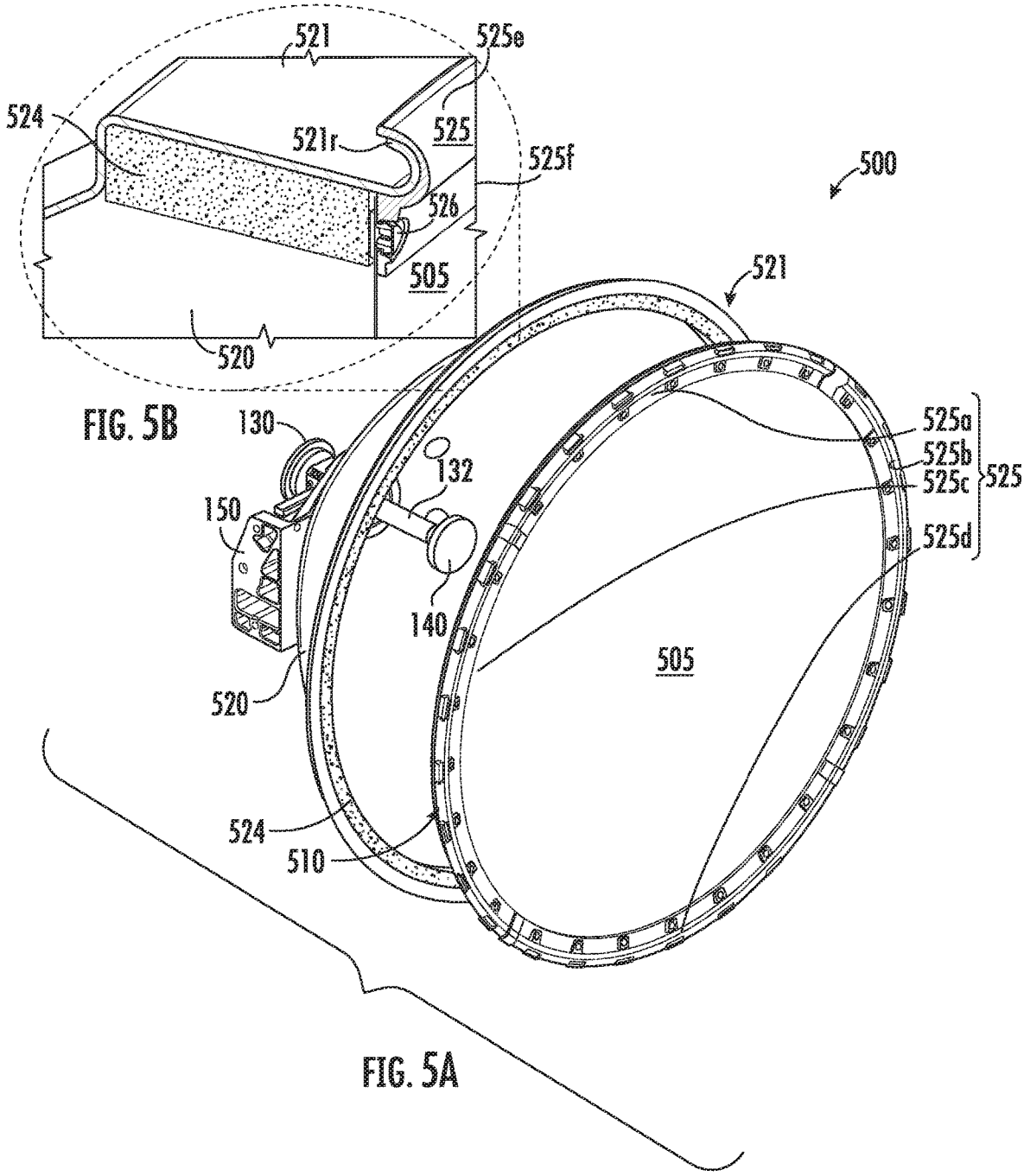
FIG. 5A is an exploded perspective view illustrating flexible radome structures for multi-band operation in accordance with yet further embodiments described herein.
FIG. 5B is an enlarged view illustrating a cross-section of a portion of the reflector rim of the flexible radome structure of FIG. 5A.

FIG. 5A is an exploded perspective view illustrating a flexible radome structure 500 for multi-band operation in accordance with yet further embodiments described herein. FIG. 5B is an enlarged view illustrating a cross-section of a portion of the reflector rim 521 of the flexible radome structure 500 of FIG. 5A.

As shown in FIGS. 5A and 5B, the flexible radome structure 500 includes a flexible radome assembly 510 including a shield rim 525 that is configured to be attached to a rim 521 of a reflector 520. The shield rim 525 may be a molded plastic or other non-conductive member including segments 525*a*, 525*b*, 525*c*, 525*d* that collectively define an inner perimeter or circumference that is sized to be attached to an outer perimeter or circumference of the radome assembly 510. The rim 521 of the reflector 520 includes a rolled edge 521*r* that is sized to fit in a corresponding clip portion 525*p* at the outer edge 525*e* of each of the molded rim segments 525*a*, 525*b*, 525*c*, 525*d*. The inner edge 525*f* of each of the molded rim segments 525*a*, 525*b*, 525*c*, 525*d* includes holes or openings therein to attach a flexible (e.g., fabric) radome 505, for example, by plastic studs, pins, or rivets 526. The reflector 520 may also include a compressible absorber member 524 extending along and within a boundary defined by the rim 521.

The radome assembly 510 may thus be assembled onto the rim 521 of the reflector by attaching the respective clip portions 525*p* at the outer edges 525*e* of the shield rim 525 to the rolled edge 521*r* of the rim 521 of the reflector 520. That is, the radome assembly 510 is held in place by a snap-fit interface between the segments 525*a*, 525*b*, 525*c*, 525*d* of the shield rim 525 and the rolled edge 521*r* of the rim 521. In the embodiments of FIGS. 5A and 5B, tension is applied to the flexible radome 505 directly by the attachment to the shield rim 525, without the use of a separate tensioning member (such as the rod 315 of FIGS. 3A-3D). That is, the shield rim 525 functions as both the attachment member and the tensioning member for the radome 505. While illustrated as including four segments 525*a*-525*d* that collectively define a complete circumference around the rim 521 by way of example, it will be understood that the shield rim 525 may be include more segments, may be a single member, or may define only a partial circumference around the rim 521 in some embodiments.

Figure 6A:
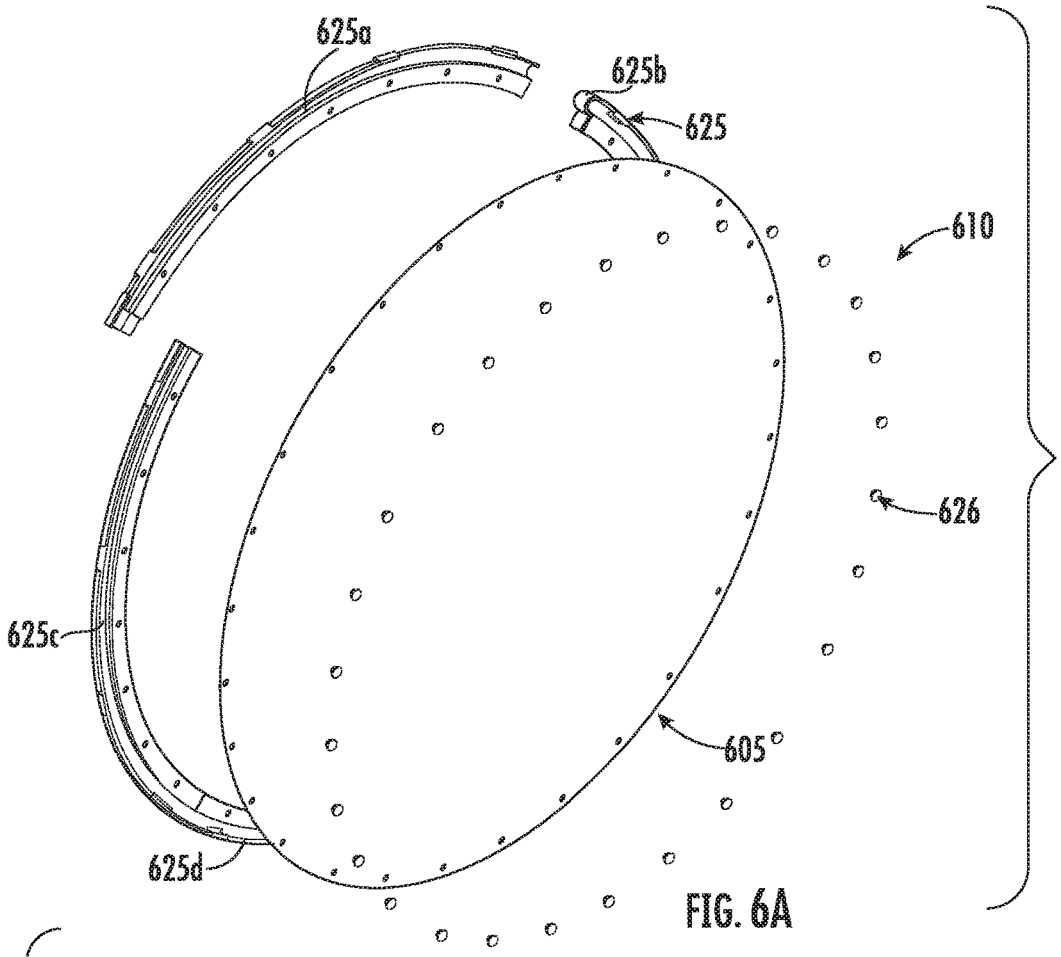
FIGS. 6A and 6B are exploded and enlarged views, respectively, illustrating flexible radome assemblies for multi-band operation in accordance with further embodiments described herein.
Figure 6B:
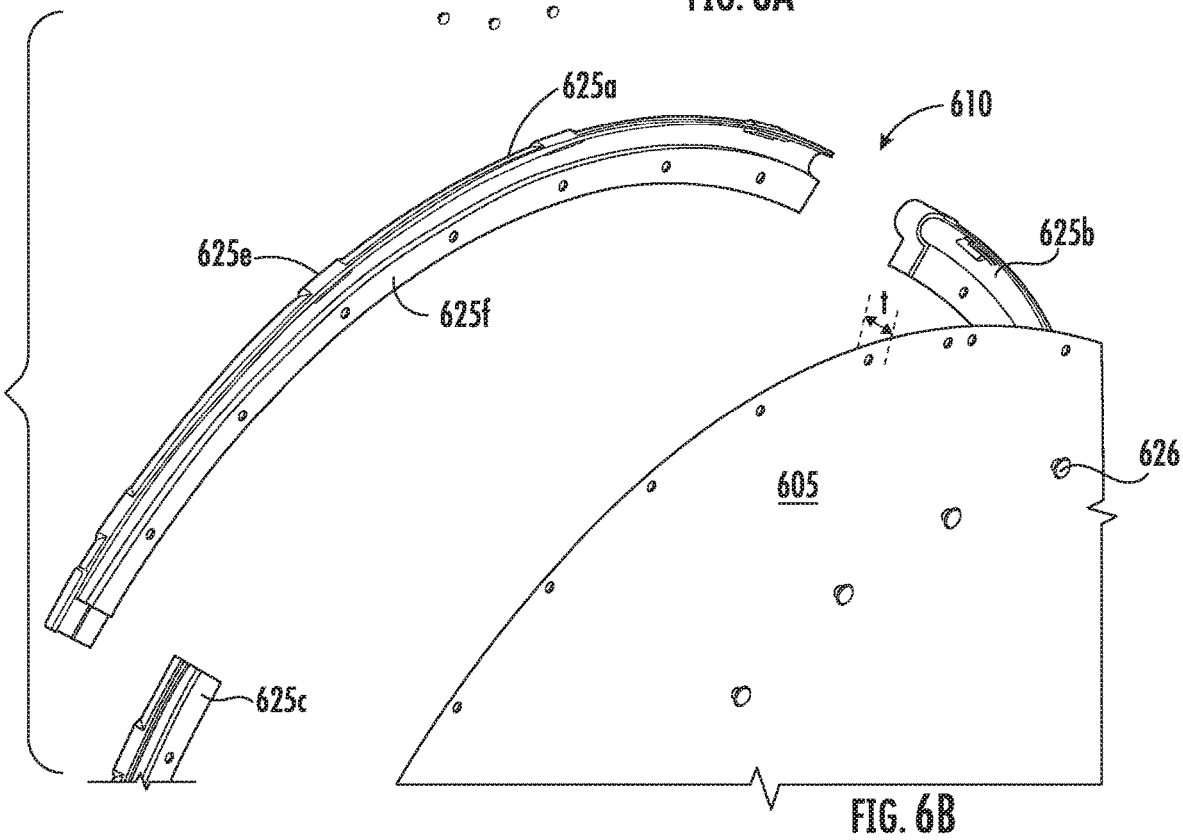

FIGS. 6A and 6B are exploded and enlarged views, respectively, illustrating a flexible radome assembly 610 for multi-band operation in accordance with further embodiments described herein. The flexible radome assembly 610 may be representative of embodiments of radome assemblies described herein, for example, the radome assembly 510 described above.

As shown in FIGS. 6A and 6B, the radome assembly 610 includes a fabric (or other flexible material) radome 605 that is supported and tensioned by a molded plastic shield rim 625 including segments 625*a*, 625*b*, 625*c*, 625*d* having respective inner edges 625*f* that collectively define an inner circumference that is sized to correspond to an outer circumference of the radome 605. The inner edge 625*f* of each of the segments 625*a*, 625*b*, 625*c*, 625*d* includes holes or openings therein to which a flexible (e.g., fabric) radome 605 is attached, for example, by plastic studs, pins, or rivets 626.

In some embodiments the radome assembly 610 may be fabricated by gluing, snapping, or otherwise affixing the segments 625*a*, 625*b*, 625*c*, 625*d* together at ends thereof to define the shield rim 625 as a ring or frame for the radome. The fabric (or other flexible material) radome 605 is pre-tensioned over the shield rim 625, and attached to the outer circumference of the flexible radome 605 to the inner circumference defined by the inner edges 625*e* of the shield rim 625 by placing the studs 626 through respective holes in the outer circumference of the flexible radome 605 and corresponding holes in the inner edges 625*e* of the shield rim 625. The flexible radome 605 is made of a material that is resistant to stretching or sagging, and thus, the pinning of the radome 605 to the shield rim 625 maintains the tension created by pre-tensioning the flexible radome 605. Excess material of the flexible radome 605 may be trimmed to complete the radome assembly 610. The outer edges 625*e* of the segments 625*a*, 625*b*, 625*c*, 625*d* may include respective clip portions 625*p* that are configured to be attached (e.g., by snap-fit) to a rolled edge of a rim of a reflector, such as the rolled edge 521*r* of the rim 521 of the reflector 520 of FIG. 5A.

Figure 7B:
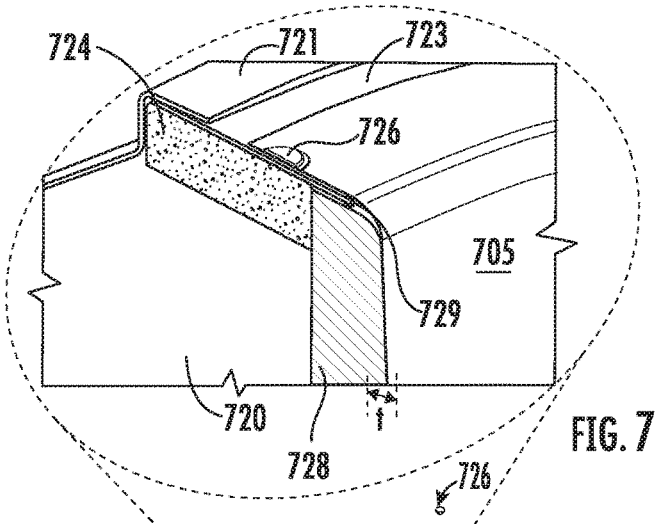
FIG. 7B is an enlarged view illustrating a cross-section of a portion of the reflector rim of the flexible radome structure of FIG. 7A.
Figure 7A:
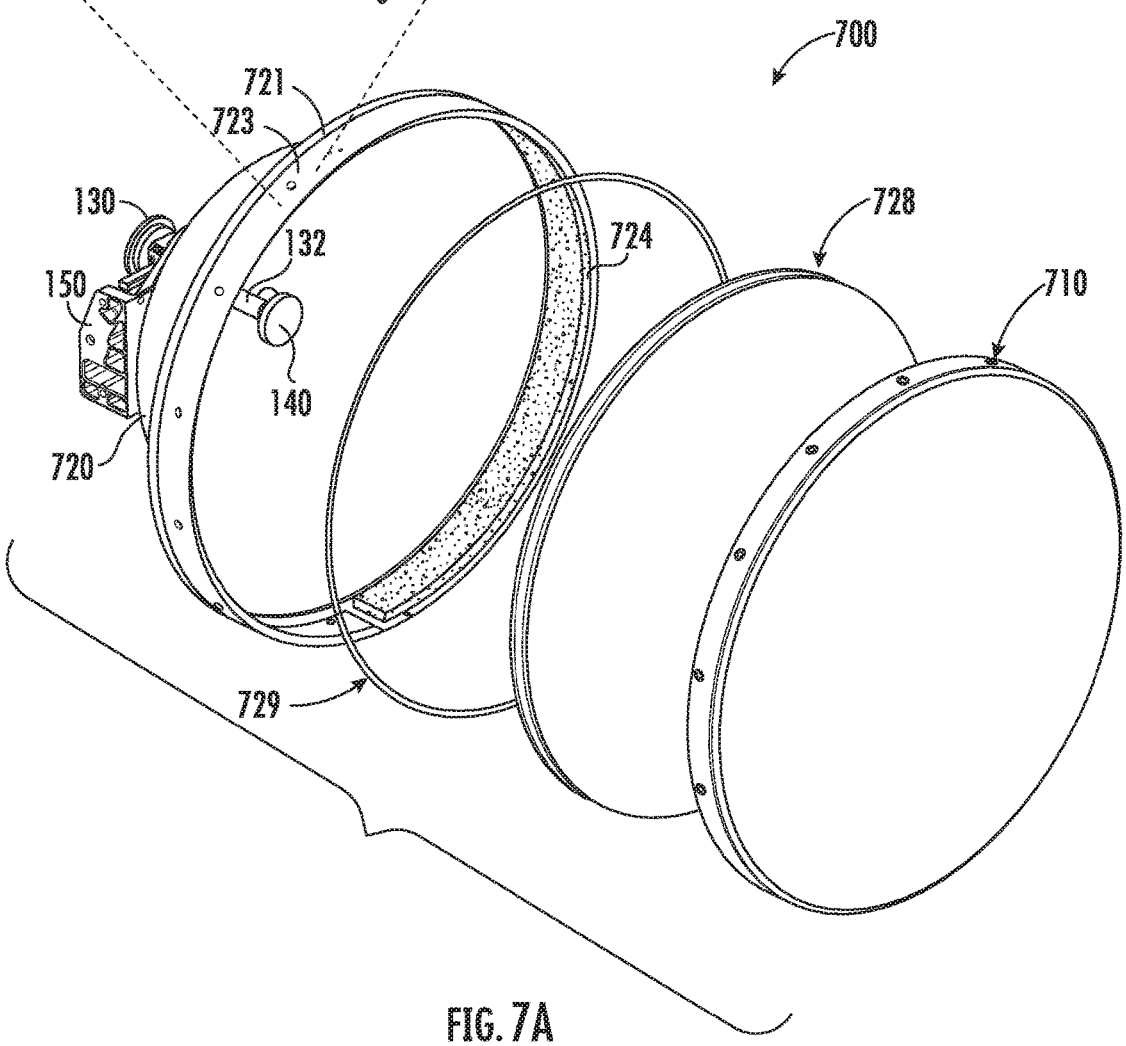
FIG. 7A is an exploded perspective view illustrating flexible radome structures in accordance with still yet further embodiments described herein.

FIG. 7A is an exploded perspective view illustrating a flexible radome structure 700 in accordance with still yet further embodiments described herein. FIG. 7B is an enlarged view illustrating a cross-section of a portion of the reflector rim 721 of the flexible radome structure 700 of FIG. 7A.

As shown in FIGS. 7A and 713, the flexible radome structure 700 includes a flexible radome assembly 710 that is attached to a shield member 723 that extends along a rim 721 of a reflector 720. The shield 723 defines a ring or frame to which a flexible (e.g., fabric) radome 705 is attached, for example, by inserting studs 726 into rings in the flexible radome 705 (or into a shield rim extending along the perimeter of the radome 705) and into corresponding holes in the shield 723. The shield 723 may be secured to the rim 721 of the reflector 720 by friction, glue/adhesive, and/or other attachment elements. The reflector 720 also includes a compressible absorber member 724 extending along the circumference of the rim 721 and within a boundary defined by the shield 723. The absorber member 724 may be a pliable material, which may expand responsive to compression.

Figure 8B:
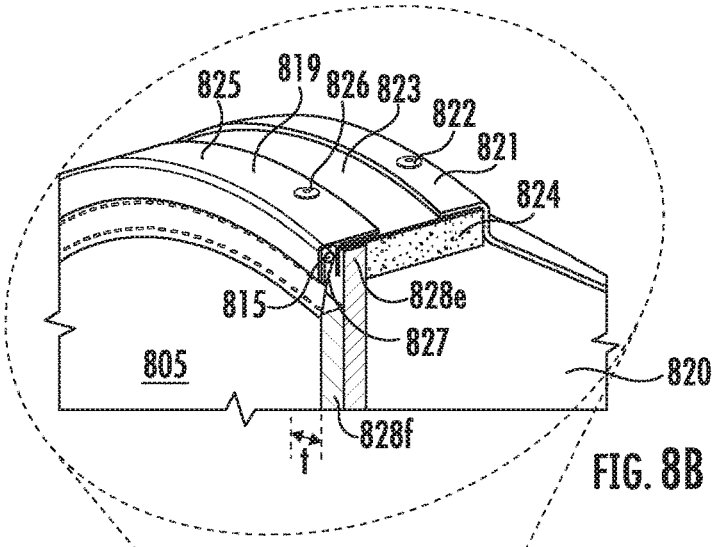
FIG. 8B is an enlarged view illustrating a cross-section of a portion of the reflector rim of the flexible radome structure of FIG. 8A.
Figure 8A:
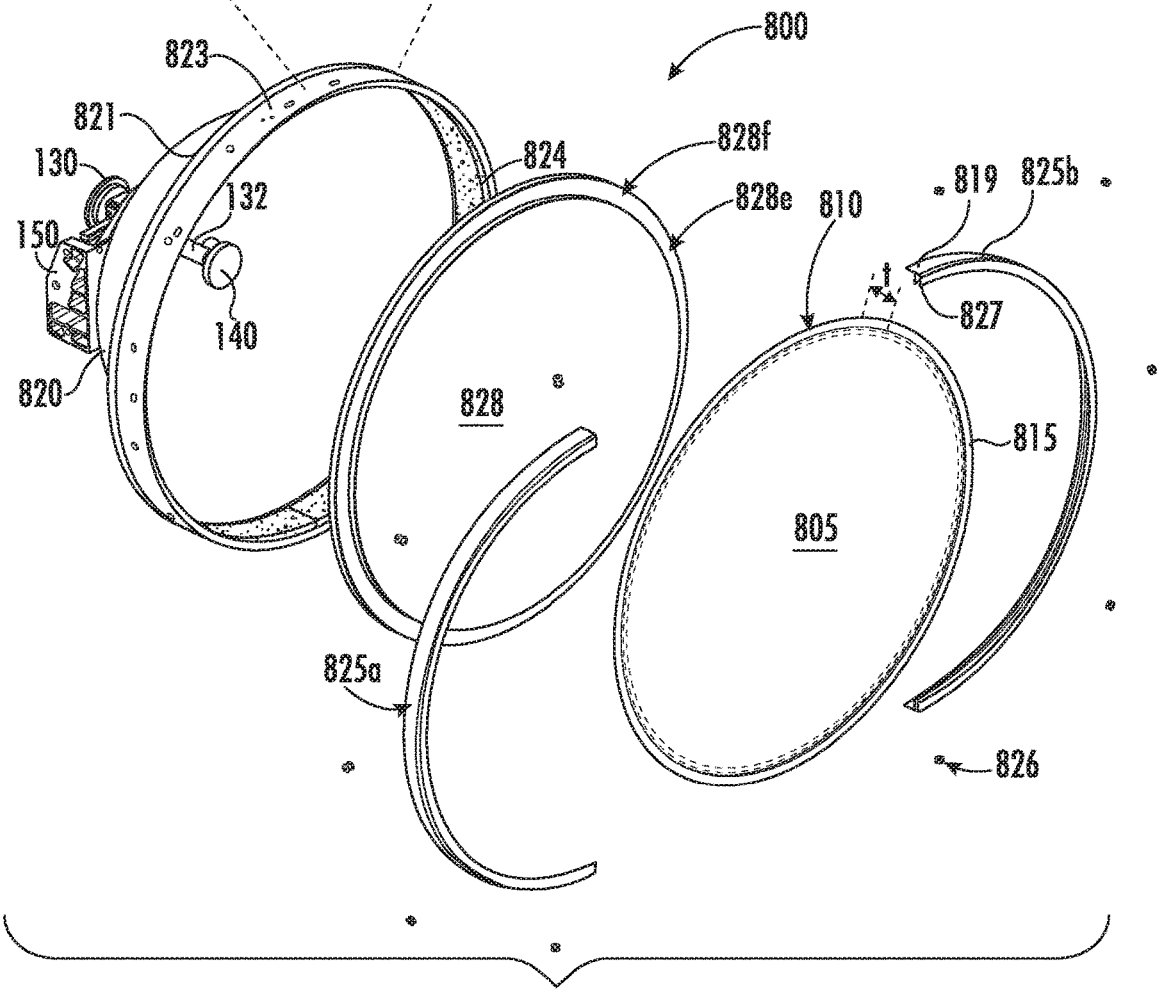
FIG. 8A is an exploded perspective view illustrating flexible radome structures for multi-band operation in accordance with some further embodiments described herein.

The flexible radome structure 700 also includes an expandable disc 728 and a rim edge strip 729, which have respective circumferences that are similar to that of the radome assembly 710. The expandable disc 728 may be a polystyrene or other low-loss material that may have no substantial impact on radiation patterns, and may expand responsive to compression. The radome assembly 710 may be assembled onto the rim 721 of the reflector 720 by attaching an attachment channel defined by the rim edge strip 729 over the edge of the shield 723 (e.g., by friction fit), placing the expandable disc 728 within the circumference of the shield 723 so as to abut an outer-facing surface of the absorber member 724, placing the flexible radome 705 over the expandable disc 728 such that the rings along the outer edge of the radome assembly 710 are aligned with the holes in the shield, and inserting the studs 726 through the holes in the radome assembly 710 and into the corresponding holes in the shield 723. The absorber member 724 and/or the disc 728 may expand responsive to the compression exerted by attaching the flexible radome 705 to the shield 723, acting as a spring to apply tension to the flexible radome 705. In particular, expansion of the absorber member 724 may press the abutting disc 728 against the surface of the flexible radome 705, thereby maintaining tension in the surface of the flexible radome 705. That is, the absorber member 724 and/or disc 728 may function as the tensioning member for the radome 705, FIG. 8A is an exploded perspective view illustrating a flexible radome structure 800 for multi-band operation in accordance with some further embodiments described herein. FIG. 8B is an enlarged view illustrating a cross-section of a portion of the reflector rim 821 of the flexible radome structure 800 of FIG. 8A.

As shown in FIGS. 8A and 8B, the flexible radome structure 800 includes a flexible radome assembly 810 that is attached to a shield member 823 that extends along the rim 821 of a reflector 820. The shield 823 defines a ring or frame to which the radome assembly 810 is attached by a shield rim 825 and a plurality of rivets 826 (or other attachment elements). The shield 823 is illustrated as being secured to the rim 821 of the reflector 820 by a plurality of rivets 822 inserted into correspondingly-sized holes in a lip 819 of the shield 823 and rim 821, but may be similarly secured by friction, glue/adhesive, and/or other attachment elements. The reflector 820 includes a compressible absorber member 824 extending along the circumference of the rim 821 and within a boundary defined by the shield 823. The absorber member 824 may be a pliable material, which may expand responsive to compression.

In FIGS. 8A and 8B, the shield rim 825 is illustrated as including segments 825*a*, 825*b*, which have respective slots 827 that are sized to accept an outer edge of the radome assembly 810. More particularly, the slots 827 defined by the two segments 825*a*, 825*b* of the shield rim 825 define a circumferential retaining channel 827 that is sized to accept a rod 815 which defines a ring or frame that supports the flexible radome 805. While illustrated as including two halves or segments 825*a*, 825*b* that collectively define a complete circumferential retaining channel 827 by way of example, it will be understood that the shield rim 825 may be include more segments, a single member, or may define a partial retaining channel that extends less than the complete circumference in some embodiments.

The radome assembly 810 includes a rod 815 (for example, a fiberglass or other bendable rod) including ends that are held together by a connection member (for example, a thimble or ferrule). The rod 815 extends through a sleeve or tube defined along a circumference of a fabric (or other flexible material) radome 805. In some embodiments, the rod 815 may not apply substantial tension to the flexible radome 805. In other embodiments, a circumference of an ellipse defined by bending the rod 815 can be adjusted to tension the flexible radome 805.

Still referring to FIGS. 8A and 8B, the flexible radome structure 800 also includes an expandable disc 828 having a circumference similar to that of the radome assembly 810. The expandable disc 828 may be a polystyrene or other low-loss material that may have no substantial impact on radiation patterns, and may expand responsive to compression. The disc 828 includes an outer edge or lip 828*e* that is recessed relative to an inner portion 828*f*. That is, the inner portion 828*f* of the disc 828 may have a thickness that is greater than that of the outer edge 828*e*. The width or thickness of the lip 828*e* may be sized to fit in a space defined between the absorber member 824 and the portion of the shield rim 825 defining the retaining channel 827 for the radome assembly 810 once assembled on the rim 821.

In particular, the radome assembly 810 may be assembled onto the rim 821 of the reflector 820 by placing the expandable disc 828 within the circumference of the shield 823 such that the outer edge 828*e* thereof abuts an outer-facing surface of the absorber member 824, assembling the segments 825*a*, 825*b* of the shield rim 825 on opposing sides of the radome assembly 810 by sliding the slots 827 in the segments 825*a*, 825*b* over the rod 815 that supports the flexible radome 805, placing the radome assembly 810 over the expandable disc 828 such that the inner portion 828*f* of the disc 828 contacts the surface of the flexible radome 805 and the holes along the lip 819 of the shield rim 825 are aligned with the holes in the shield 823, and inserting the rivets 826 through holes along the shield rim 825 and into the corresponding holes in the shield 823. The expandable disc 828 may compress the absorber member 824 responsive to attaching the radome assembly 810 to the shield 823, and the absorber member 824 may responsively exert a spring force against the expandable disc 828 such that the inner portion 828*f* of the disc 828 applies tension to the surface of the flexible radome 805. That is, the absorber member 824 and/or disc 828 may also function as a tensioning member for the radome 805.

Figure 9B:
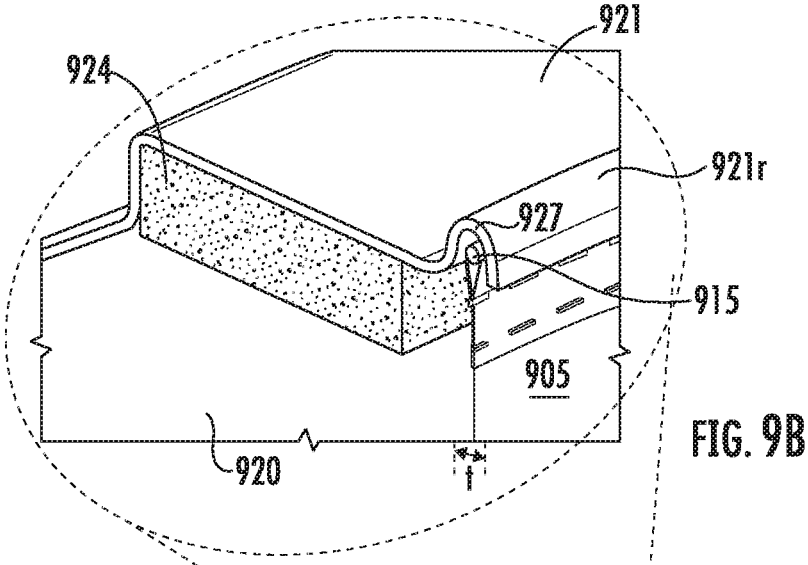
FIG. 9B is an enlarged view illustrating a cross-section of a portion of the reflector rim of the flexible radome structure of FIG. 9A.
Figure 9A:
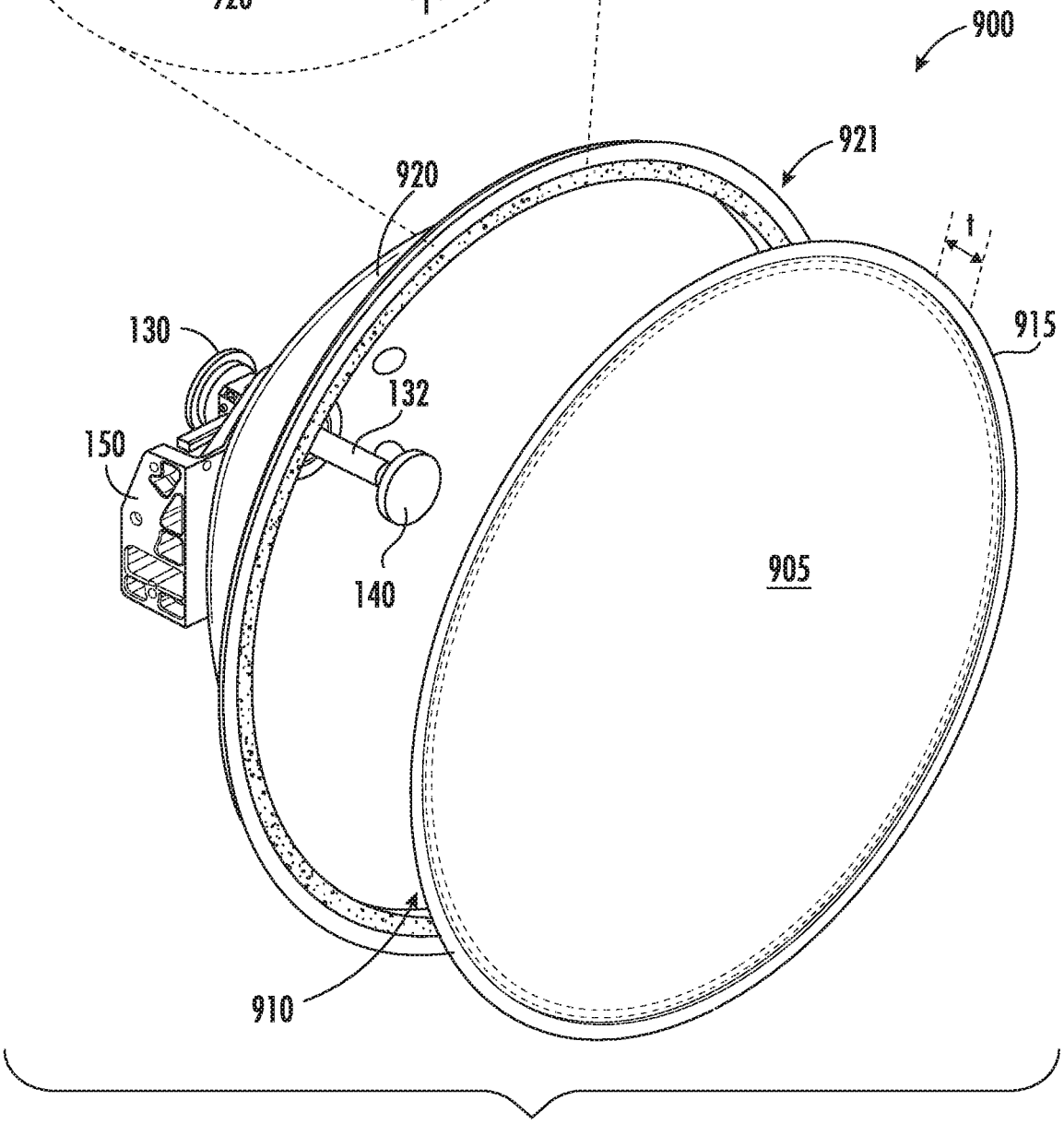
FIG. 9A is an exploded perspective view illustrating flexible radome structures for multi-band operation in accordance with some still further embodiments described herein.

FIG. 9A is an exploded perspective view illustrating a flexible radome structure 900 for multi-band operation in accordance with some still further embodiments described herein. FIG. 9B is an enlarged view illustrating a cross-section of a portion of the reflector rim 921 of the flexible radome structure 900 of FIG. 9A.

As shown in FIGS. 9A and 9B, the flexible radome structure 900 includes a flexible radome assembly 910 that is attached to a rim 921 of a reflector 920. The rim 921 of the reflector 920 includes a rolled edge 921*r* that defines a circumferential trench or retaining channel 927 adjacent the front (i.e., the radiating aperture) of the reflector 920. The retaining channel 927 is sized to accept a tensioning member 915 which maintains the tension in the surface of the flexible radome 905. In contrast to the embodiments of FIGS. 4 and 5, the radius of curvature of the rolled edge 921*r* is in front of the reflector 920. The reflector 920 may also include a compressible absorber member 924 extending within a boundary defined by the rim 921, The absorber member 924 may be a pliable material, which may expand responsive to compression, and may extend along a periphery of (but not so as to obstruct) the entrance or opening of circumferential retaining channel 927.

As similarly described above with reference to FIGS. 3A-3D, the radome assembly 910 includes a tensioning member 915 (for example, a fiberglass or other bendable rod) including ends that are held together by one or more connection members (for example, male and female thimbles, threaded ferrules, etc.). The tensioning member 915 extends through a sleeve or tube defined along a circumference of a fabric (or other flexible material) radome 905. A circumference of an ellipse defined by bending the tensioning member 915 can be adjusted (e.g., by unscrewing portions of the connection members) to tension the flexible radome 905.

Assembly of the flexible radome structure 900 includes twisting, bending, or otherwise deforming the tensioning member 915 to temporarily reduce an overall diameter of the radome assembly 910, and positioning the outer edge of the radome assembly 910 (including the tensioning member 915) into the retaining channel 927 defined by the rolled edge 921*r* of the rim 921. The tensioning member 915 may have sufficient elasticity to untwist, straighten, or otherwise expand to resume its shape in the retaining channel 927 defined by the rolled edge 921*r* of the reflector rim 921, such that the tensioning member 915 simultaneously secures the radome assembly 910 to the rim and maintains tension in the surface of the flexible radome 905 by expansion into the retaining channel 927, without the need for a separate shield rim (e.g., in a manner similar to a pop-up tent). The retaining channel 927 may be formed as part of the reflector 920 as shown in FIGS. 9A and 9B, or may be separately formed and attached to the reflector 920 in some embodiments.

Figure 10B:
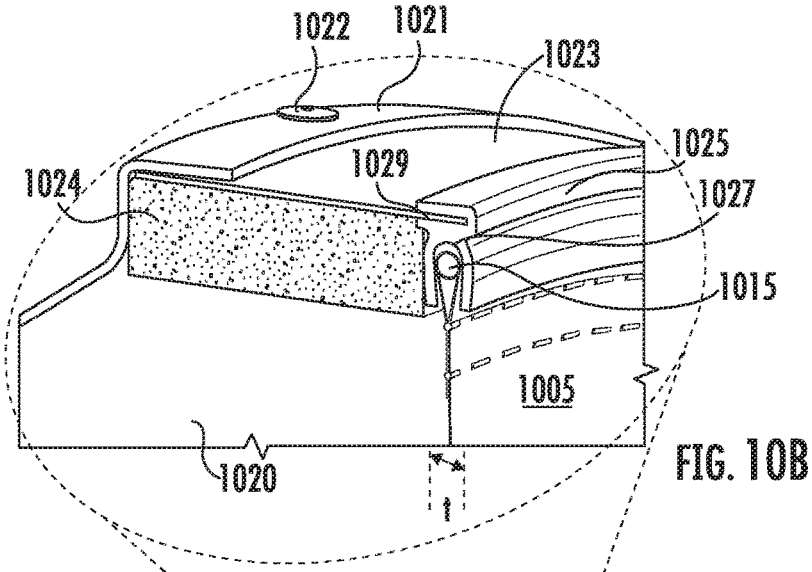
FIG. 10B is an enlarged view illustrating a cross-section of a portion of the reflector rim of the flexible radome structure of FIG. 10A.
Figure 10A:
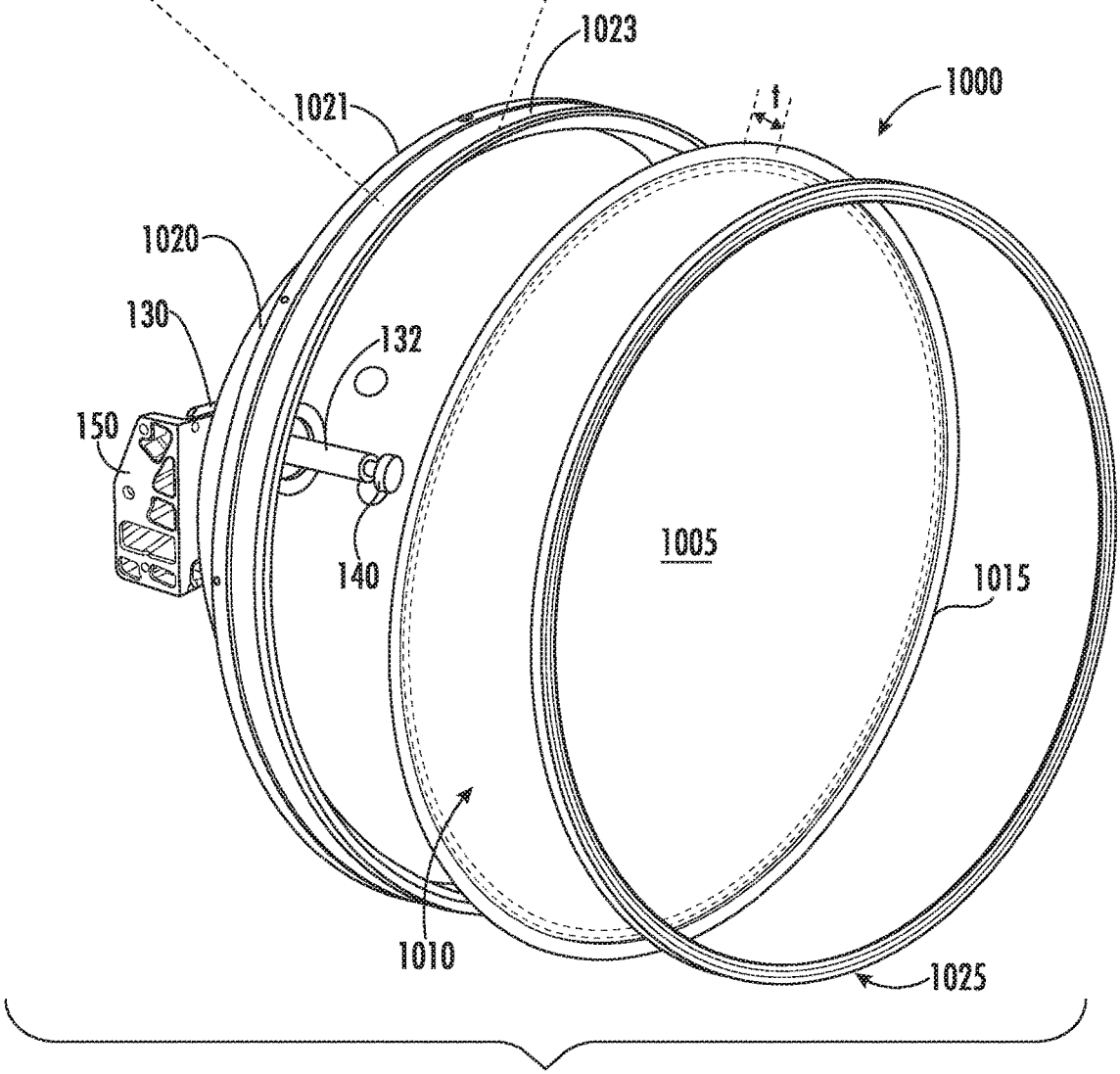
FIG. 10A is an exploded perspective view illustrating flexible radome structures for multi-band operation in accordance with some yet still further embodiments described herein.

FIG. 10A is an exploded perspective view illustrating a flexible radome structure 1000 for multi-band operation in accordance with some yet still further embodiments described herein, FIG. 10B is an enlarged view illustrating a cross-section of a portion of the reflector rim 1021 of the flexible radome structure 1000 of FIG. 10A.

As shown in FIGS. 10A and 10B, the flexible radome structure 1000 includes a flexible radome assembly 1010 that is attached to a shield member 1023 that extends along the rim 1021 of a reflector 1020. The shield 1023 defines a ring or frame to which the radome assembly 1010 is attached by a retention strip 1025. The shield 1023 is illustrated as being secured to the rim 1021 of the reflector 1020 by a plurality of rivets 1022 inserted into correspondingly-sized holes in the shield 1023 and rim 1021, but may be similarly secured by friction, glue/adhesive, and/or other attachment elements.

The retention strip 1025 has a shape corresponding to that of the radome assembly 1010, and is configured to both suspend the radome assembly 1010 and attach the radome assembly 1010 to the shield 1023. In particular, the retention strip 1025 has a circumference corresponding to that of the shield 1023, and includes an attachment channel 1029 that is sized to accept an edge of the shield 1023. The retention strip 1025 also defines a circumferential trench or retaining channel 1027 adjacent the front (i.e., the radiating aperture) of the reflector 1020. The retaining channel 1027 is sized to accept a tensioning member 1015 which maintains the tension in a surface of the flexible radome 1005. The retention strip 1025 may be a reinforced polymer extrusion (e.g., steel-reinforced PVC) in some embodiments. The attachment channel 1029 and the retaining channel 1027 may have respective depth dimensions extending into different surfaces of the retention strip 1025, and the depth dimensions may be perpendicular to one another in some embodiments.

The reflector 1020 also includes a compressible absorber member 1024 extending along the circumference of the rim 1021 and within a boundary defined by the shield 1023. The absorber member 1024 may be a pliable material, which may expand responsive to compression, and may extend along a periphery of (but not so as to obstruct) the entrance or opening of circumferential retaining channel 1027 once the retention strip is assembled onto the edge of the shield 1023.

As similarly described above with reference to FIGS. 3A-3D, the radome assembly 1010 includes a tensioning member 1015 (for example, a stainless steel or other bendable rod) including ends that are held together by one or more connection members. The tensioning member 1015 extends through a sleeve or tube defined along a circumference of a fabric (or other flexible material) radome 1005. A circumference of an ellipse defined by bending the tensioning member 1015 can be adjusted (e.g., by unscrewing portion(s) of the connection members) to expand or increase the circumference and thus tension the flexible radome 1005.

Assembly of the flexible radome structure 1000 includes pressing the outer edge (including the tensioning member 1015) of the radome assembly 1010 into the retaining channel 1027 of the retention strip 1025, and pushing the retention strip 1025 (including the radome assembly 1010 in the channel 1027) onto the edge of the shield 1023. That is, the radome assembly 1010 may be secured in the retention strip 1025 by friction fit between the tensioning member 1015 and the interior of the retaining channel 1027, and the retention strip 1025 may likewise be secured by friction fit onto the shield 1023 by inserting the edge of the shield 1023 into the attachment channel 1029. However, it will be understood that adhesives and/or other attachment elements may be used. The retention strip 1025 may thus define both the retaining channel 1027 around the edge of the flexible radome 1005, and a shield rim around the edge of the shield 1023.

Figure 11A:
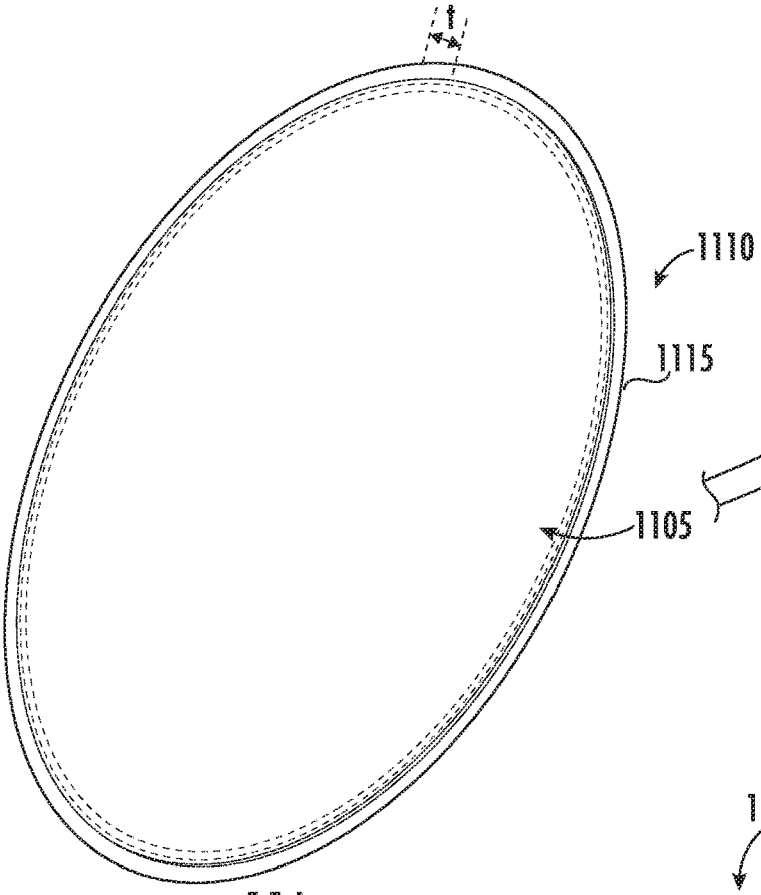
FIG. 11A is a perspective view illustrating flexible radome assemblies for multi-band operation in accordance with some embodiments described herein.
Figure 11B:
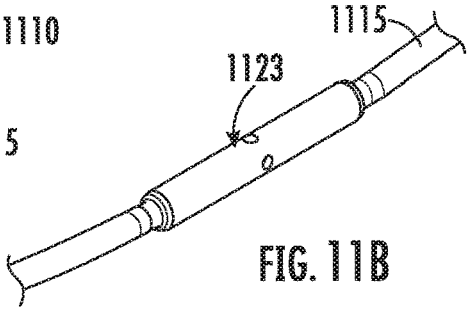
FIG. 11B is an enlarged view of the connection members of the radome assembly of FIG. 11A.
Figure 11C:
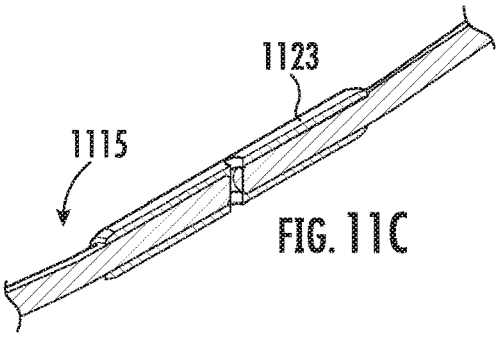
FIG. 11C is a cross-sectional view of the connection members of FIG. 11B.

FIGS. 11A, 11B, and 11C are perspective, enlarged, and cross-sectional views, respectively, illustrating a flexible radome assembly 1110 and components thereof for multi-band operation in accordance with some embodiments described herein. The radome assembly 1110 may be representative of embodiments of radome assemblies described herein, for example, the radome assembly 1010 described above.

As shown in FIGS. 11A-11C, the radome assembly 1110 includes a bendable rod 1115 (for example, a stainless steel, pre-rolled rod) including a connection member 1123 attaching respective ends thereof, and a fabric (or other flexible material) radome 1105 supported by the shape of the rod 1115. For example, one end of the rod 1115 may include clockwise (CW) threading, the other end of the rod 1115 may include anti-clockwise (ACW) threading, and the connection member 1123 may be a threaded ferrule (having one side with CW threading, and the other with ACW threading) attaching the two ends to define a ring-shaped or elliptical frame that supports the flexible radome 1105.

Figure 11D:
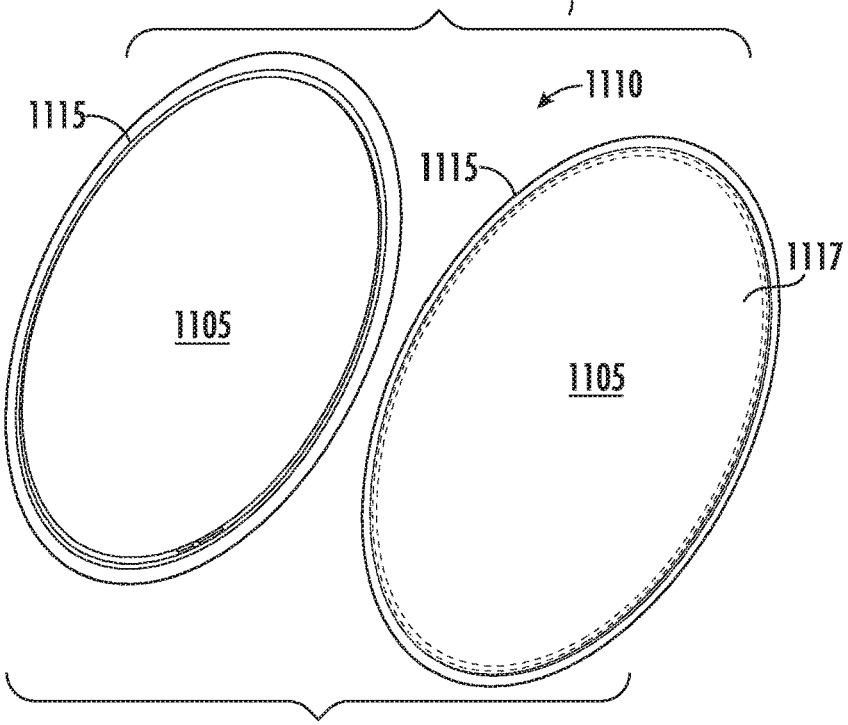
FIG. 11D illustrates operations for fabricating the radome assembly of FIG. 11A.

FIG. 11D illustrates operations for fabricating the radome assembly of FIG. 11A. As shown in FIG. 11D, the rod 1115 is bent to define an elliptical shape, and the ends of the rod 1115 are screwed into respective sides of the connection member 323. Outer edges of the flexible radome 1105 are folded over the circumference of the elliptical shape defined by the bent rod 1115 and secured to the rod 1115 (for example by stitching, welding, or gluing, generally shown as 1117), leaving a gap at least partially exposing the connection member 1123. Edges of the flexible radome 1105 folded and secured around the rod 1115 may define a fabric tube or sleeve, which has an opening that is sized and configured to allow the rod 1115 to slide therethrough. The amount by which one or both ends of the rod 1115 are screwed into the connection member 323 is then reduced (e.g., by unscrewing the ferrule), sliding the rod 1115 within the fabric sleeve to expand the circumference defined by the rod 115, thereby creating tension in the surface of the flexible radome 1105. Once tensioned, the rod assembly 1110 may be completed, for example, by stitching, welding, or gluing the remaining portion of the flexible radome 1105 to close the gap around the connection member 1123.

Figure 12B:
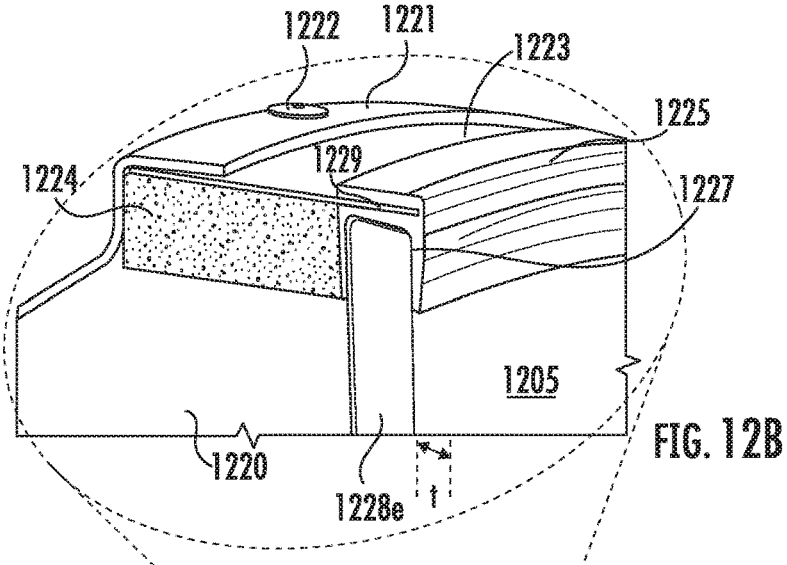
FIG. 12B is an enlarged view illustrating a cross-section of a portion of the reflector rim of the flexible radome structure of FIG. 12A.
Figure 12A:
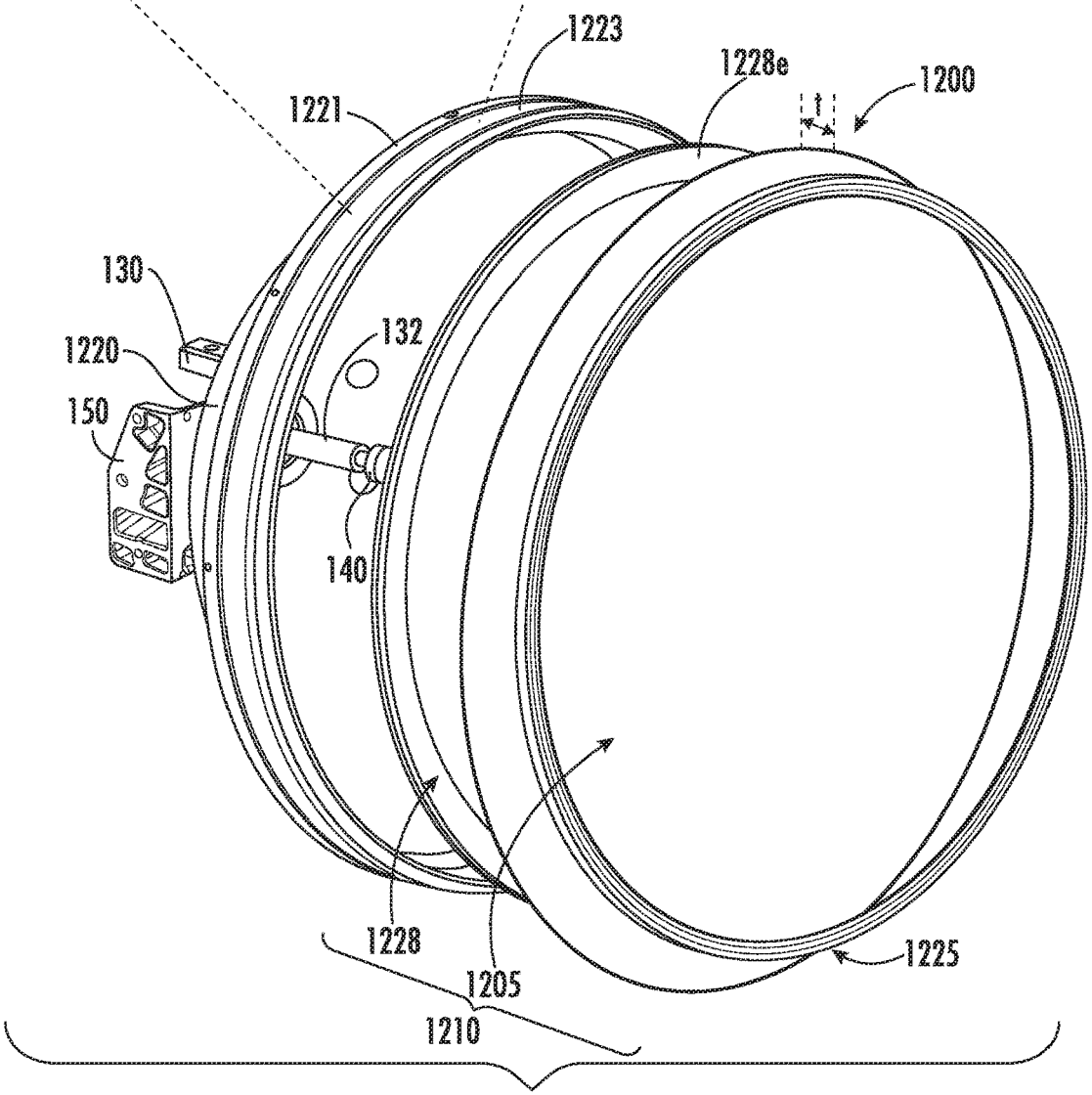
FIG. 12A is an exploded perspective view illustrating flexible radome structures for multi-band operation in accordance with some further embodiments described herein.
Figure 13:
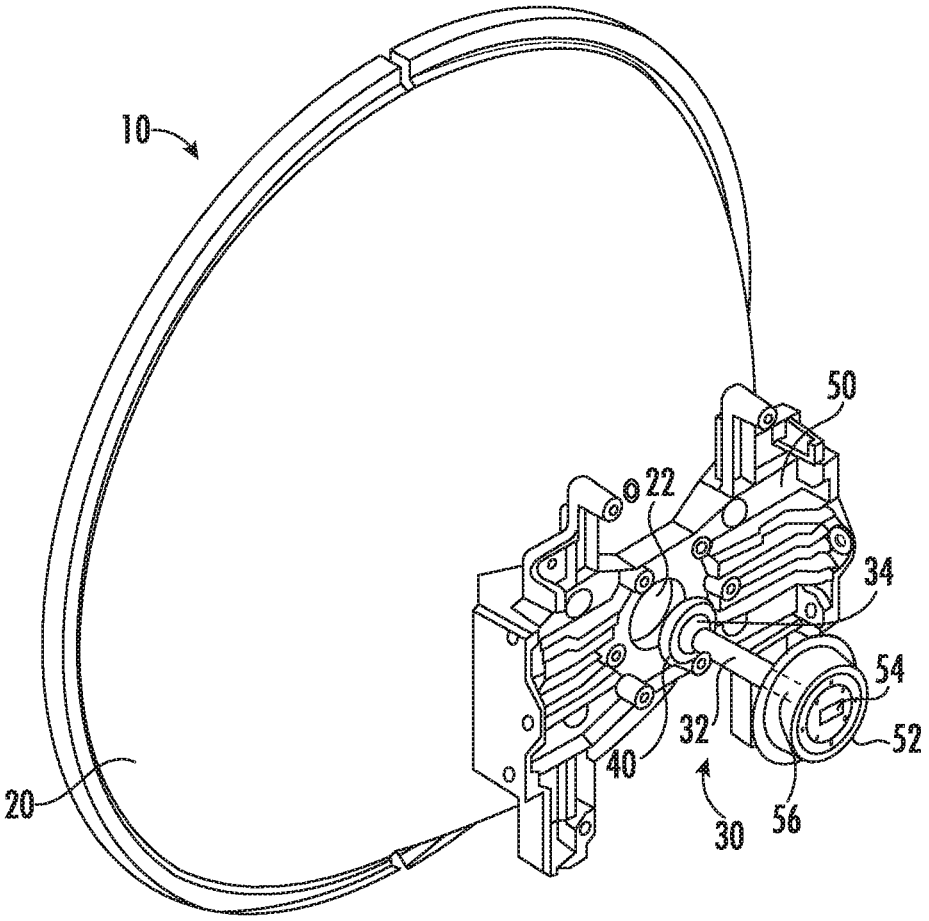
FIG. 13 is a partially-exploded, rear perspective view of a conventional microwave antenna system that uses a parabolic reflector antenna.

FIG. 12A is an exploded perspective view illustrating a flexible radome structure 1200 for multi-band operation in accordance with some further embodiments described herein. FIG. 12B is an enlarged view illustrating a cross-section of a portion of the reflector rim 1221 of the flexible radome structure 1200 of FIG. 12A.

As shown in FIGS. 12A and 12B, the flexible radome structure 1200 includes a flexible radome assembly 1210 that is attached to a shield member 1223 that extends along the rim 1221 of a reflector 1220. The shield 1223 defines a ring or frame to which the radome assembly 1210 is attached by a retention strip 1225. The shield 1223 is illustrated as being secured to the rim 1221 of the reflector 1220 by a plurality of rivets 1222 inserted into correspondingly-sized holes in the shield 1223 and rim 1221, but may be similarly secured by friction, glue/adhesive, and/or other attachment elements.

The retention strip 1225 has a shape corresponding to that of the radome assembly 1210, and is configured to both suspend and attach the radome assembly 1210 to the shield 1223. In particular, the retention strip 1225 has a circumference corresponding to that of the shield 1223, and includes an attachment channel 1229 that is sized to accept an edge of the shield 1223. The retention strip 1225 also defines a circumferential trench or retaining channel 1227 adjacent the front (i.e., the radiating aperture) of the reflector 1220. The retaining channel 1227 is sized to accept a tensioning member (here, an expandable disc 1228) which maintains the tension in a surface of the flexible radome 1205. The retention strip 1225 may be a reinforced polymer extrusion (e.g., steel-reinforced PVC) in some embodiments. The attachment channel 1229 and the retaining channel 1227 may have respective depth dimensions extending into different surfaces of the retention strip 1225, and the depth dimensions may be perpendicular to one another in some embodiments.

The radome assembly 1210 includes the flexible radome 1205 and the expandable disc 1228. The expandable disc 1228 has a circumference similar to that of the flexible radome 1205, and a width or thickness that is sized to fit in the retaining channel 1227. The expandable disc 1228 may be a polystyrene or other low-loss material that may have no substantial impact on radiation patterns, and may expand responsive to compression to provide a friction fit in the retaining channel 1227 when inserted with the flexible radome 1205 on a surface thereof. In some embodiments, the disc 1228 may include an outer edge or lip 1228*e* having a width or thickness that is sized to fit (along with the flexible radome 1205) in the retaining channel 1227, but may include an inner portion with a different thickness than the outer edge 1228*e*. Edge portions of the flexible radome 1205 may be wrapped around the outer edge 1228*e* of the disc 1228 before insertion into the channel 1227 in some embodiments. The expansion of the surface of the disc 1228 against the flexible radome 1205 applies tension to the surface of the flexible radome 1205, such that the disc 1228 functions as a tensioning member for the radome 1205 independent of assembly onto the reflector 1220.

The reflector 1220 also includes a compressible absorber member 1224 extending along the circumference of the rim 1221 and within a boundary defined by the shield 1223. The absorber member 1224 may be a pliable material, which may expand responsive to compression, and may extend along a periphery of (but not so as to obstruct) the entrance or opening of circumferential retaining channel 1227 once the retention strip is assembled onto the edge of the shield 1223.

Assembly of the flexible radome structure 1200 includes placing the flexible radome 1205 on the surface of the disc 1228 and pressing the outer edge 1228*e* of the disc 1228 into the retaining channel 1227 of the retention strip 1225, thereby trapping the edge of the flexible radome 1205 between the inner sidewall of the retaining channel 1227 and the surface of the disc 1228 and applying tension to the surface of the flexible radome 1205. The retention strip 1225 (including the radome assembly 1210 in the channel 1227) can be pushed onto the edge of the shield 1223 to attach the radome assembly 1210 to the reflector 1220. That is, the radome assembly 1210 may be secured in the retention strip 1225 by friction fit between the expandable disc 1228 and the interior of the retaining channel 1227, and the retention strip 1225 may likewise be secured by friction fit onto the shield 1223 by inserting the edge of the shield 1223 into the attachment channel 1229. However, it will be understood that adhesives and/or other attachment elements may be used. The retention strip 1225 may thus define both the retaining channel 1227 around the edge of the flexible radome 1205, and a shield rim around the edge of the shield 1223. Once assembled, the inner-facing surface of the retention strip 1225 abuts an outer-facing surface of the absorber member 1224.

From the foregoing, it will be apparent that embodiments of the present invention provide radome structures including a fabric (or other flexible) radome having an integrated mechanical tensioning feature. In some embodiments, the radome assembly may apply tension to the surface of the radome independent of attachment to the reflector or other antenna enclosure. The radome has a thickness that is much smaller than the corresponding wavelengths at the desired operating frequency bands, allowing for multi-band use, while also maintaining desired mechanical properties including (but not limited to) water-resistance, tear resistance, and/or stretch-resistance. In some embodiments, a circumferential cavity or channel can be used to retain the radome and attach the radome to cover the radiating aperture of a reflector dish, and the radome can be flexed or snap fitted into, or outside, the channel.

Other structures, devices, and methods according to embodiments described herein will be or become apparent to one with skill in the art upon review of the drawings and detailed description. It is intended that all such additional structures, devices, and methods be included within this description, be within the scope of the present inventive subject matter, and be protected by the accompanying claims. Moreover, it is intended that features disclosed herein can be implemented separately or combined in any way and/or combination.

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout. It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being on or attached to another element, it can be directly on or attached to the other element or intervening elements may also be present. In contrast, when an element is referred to as being "directly on" or "directly attached to" another element, there are no intervening elements present. Similarly, when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

Unless otherwise defined, all technical and scientific terms used herein have the same meaning as commonly understood by one of ordinary skill in the art to which this invention belongs. The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Aspects and elements of all of the embodiments disclosed above can be combined in any way and/or combination with aspects or elements of other embodiments to provide a plurality of additional embodiments.

In the drawings and specification, there have been disclosed typical embodiments of the invention and, although specific terms are employed, they are used in a generic and descriptive sense only and not for purposes of limitation, the scope of the present invention being set forth in the following claims.

That which is claimed:

1. An antenna structure, comprising:

a radiator element configured for operation at a first microwave frequency range and at a second microwave frequency range that is higher than the first microwave frequency range;

a reflector including the radiator element attached thereto, the reflector comprising an enclosure that houses the radiator element and a radiating aperture; and a radome assembly adjacent the radiating aperture, the radome assembly comprising a flexible radome having a substantially uniform thickness that is less than respective wavelengths corresponding to the first and second microwave frequency ranges, and comprising a tensioning member that extends along a perimeter of the flexible radome and maintains tension in a surface of the flexible radome.

2. The antenna structure of claim 1, wherein the flexible radome comprises a sleeve extending along the perimeter thereof, and wherein the tensioning member comprises a flexible rod extending through the sleeve and a connection member connecting ends of the flexible rod.

3. The antenna structure of claim 2, wherein the connection member comprises male and female members at the ends of the flexible rod, respectively, and wherein an amount of insertion of the male member into the female member is adjustable to alter the perimeter of the flexible radome and the tension in the surface thereof independent of attachment of the radome assembly to the antenna structure.

4. The antenna structure of claim 1, further comprising a single- or multi-segment shield rim that extends around the perimeter of the flexible radome and attaches the radome assembly to a rim of the reflector adjacent the radiating aperture.

5. The antenna structure of claim 4, wherein the shield rim comprises a plurality of holes in an inner edge thereof, and wherein the flexible radome is attached to the holes in the shield rim by respective plugs along the perimeter thereof to maintain the tension in the surface of the flexible radome independent of attachment of the radome assembly to the antenna structure.

6. The antenna structure of claim 4, wherein the shield rim comprises a retaining channel therein that is sized to accept the tensioning member of the radome assembly along an inner edge thereof, and an attachment structure that attaches to the rim of the reflector.

7. The antenna structure of claim 6, wherein the attachment structure of the shield rim comprises a lip portion including a plurality of holes therein that are sized to accept respective plugs to attach to the rim of the reflector.

8. The antenna structure of claim 6, wherein the rim of the reflector comprises a rolled edge, and wherein the attachment structure of the shield rim comprises a clip portion that is sized to accept the rolled edge of the rim of the reflector.

9. The antenna structure of claim 4, wherein the rim of the reflector includes a compressible absorber member extending along and within a boundary defined by the rim, and/or wherein the tensioning member further comprises an expandable disc having a first surface that abuts the surface of the flexible radome.

10. The antenna structure of claim 1, wherein the thickness of the flexible radome is at least ten times less than one of the respective wavelengths corresponding to the first or second microwave frequency ranges.

11. The antenna structure of claim 10, wherein the first and second microwave frequency ranges are multiple octaves apart.

12. The antenna structure of claim 11, wherein the thickness of the flexible radome is about 0.3 millimeters (mm) to about 0.05 mm.

13. An antenna structure, comprising:

a radiator element configured for operation at a first microwave frequency range and at a second microwave frequency range that is higher than the first microwave frequency range;

a reflector including the radiator element attached thereto, the reflector comprising an enclosure that houses the radiator element and a radiating aperture;

a radome assembly adjacent the radiating aperture, the radome assembly comprising a flexible radome having a thickness that is less than a wavelength corresponding to the first or second microwave frequency ranges, and comprising a tensioning member that extends along a perimeter of the flexible radome and maintains tension in a surface of the flexible radome; and a single- or multi-segment shield rim that extends around the perimeter of the flexible radome and attaches the radome assembly to a rim of the reflector adjacent the radiating aperture, wherein the rim of the reflector comprises a shield member extending along a perimeter thereof, the shield member comprising an edge protruding away from the reflector beyond the rim, and wherein the shield rim comprises an attachment channel portion extending along an outer edge thereof and sized to accept the edge of the shield member.

14. An antenna structure, comprising:

a radiator element configured for operation at a first microwave frequency range and at a second microwave frequency range that is higher than the first microwave frequency range;

a reflector including the radiator element attached thereto, the reflector comprising an enclosure that houses the radiator element and a radiating aperture;

a radome assembly adjacent the radiating aperture, the radome assembly comprising a flexible radome having a thickness that is less than a wavelength corresponding to the first or second microwave frequency ranges, and comprising a tensioning member that extends along a perimeter of the flexible radome and maintains tension in a surface of the flexible radome; and a single- or multi-segment shield rim that extends around the perimeter of the flexible radome and attaches the radome assembly to a rim of the reflector adjacent the radiating aperture, wherein the rim of the reflector includes a compressible absorber member extending along and within a boundary defined by the rim, wherein the tensioning member further comprises an expandable disc having a first surface that abuts the surface of the flexible radome, and wherein the expandable disc comprises an outer lip that is thinner than an inner portion thereof and is sized to fit between the compressible absorber member and a retaining channel of the shield rim.

15. An antenna structure, comprising:

a radiator element configured for operation at a first microwave frequency range and at a second microwave frequency range that is higher than the first microwave frequency range;

a reflector including the radiator element attached thereto, the reflector comprising an enclosure that houses the radiator element and a radiating aperture; and a radome assembly adjacent the radiating aperture, the radome assembly comprising a flexible radome having a thickness that is less than a wavelength corresponding to the first or second microwave frequency ranges, and comprising a tensioning member that extends along a perimeter of the flexible radome and maintains tension in a surface of the flexible radome, wherein the reflector comprises a rim having a rolled edge defining a retaining channel that is sized to accept the tensioning member of the radome assembly, and wherein the tensioning member is configured to expand in the retaining channel responsive to deformation thereof to secure the radome assembly to the rim of the reflector.

16. A radome assembly for an antenna structure, the radome assembly comprising:

a flexible radome having a substantially uniform thickness that is less than respective wavelengths corresponding to first and second microwave frequency operating ranges of the antenna structure; and a tensioning member that extends along a perimeter of the flexible radome and maintains tension in a surface of the flexible radome independent of attachment of the radome assembly to the antenna structure.

17. The radome assembly of claim 16, wherein the flexible radome comprises a sleeve extending along the perimeter thereof, and wherein the tensioning member comprises a flexible rod extending through the sleeve and a connection member connecting ends of the flexible rod.

18. The radome assembly of claim 17, wherein the connection member comprises male and female members at the ends of the flexible rod, respectively, and wherein an amount of insertion of the male member into the female member is adjustable to alter the perimeter of the flexible radome and the tension in the surface thereof.

19. The radome assembly of claim 16, wherein the tensioning member comprises a single- or multi-segment shield rim that extends around the perimeter of the flexible radome, wherein the shield rim comprises a plurality of holes in an inner edge thereof, and wherein the flexible radome is attached to the holes in the shield rim by respective plugs along the perimeter thereof to maintain the tension in the surface of the flexible radome.

20. The radome assembly of claim 16, wherein the thickness of the flexible radome is at least ten times less than one of the respective wavelengths corresponding to the first or second microwave frequency ranges.

21. The radome assembly of claim 20, wherein the first and second microwave frequency ranges are multiple octaves apart, and wherein the thickness of the flexible radome is about 0.3 millimeters (mm) to about 0.05 mm.

* * * * *